US008631957B2

(12) United States Patent
Dart et al.

(10) Patent No.: US 8,631,957 B2
(45) Date of Patent: Jan. 21, 2014

(54) RECLOSEABLE LID WITH CLOSURE PLUG

(75) Inventors: Robert C. Dart, Georgetown (KY); Ryan P. Gingras, Grass Lake, MI (US); Todd Atkins, Grass Lake, MI (US)

(73) Assignee: Dart Container Corporation, Mason, MI (US)

( * ) Notice: Subject to any disclaimer, the term of this patent is extended or adjusted under 35 U.S.C. 154(b) by 500 days.

(21) Appl. No.: 11/971,388

(22) Filed: Jan. 9, 2008

(65) Prior Publication Data

US 2008/0105696 A1 May 8, 2008

Related U.S. Application Data

(63) Continuation of application No. 10/065,722, filed on Nov. 13, 2002, now abandoned.

(60) Provisional application No. 60/350,706, filed on Nov. 13, 2001, provisional application No. 60/350,875, filed on Jan. 22, 2002, provisional application No. 60/410,380, filed on Sep. 13, 2002.

(51) Int. Cl.
*B65D 51/18* (2006.01)
*A47G 19/22* (2006.01)

(52) U.S. Cl.
USPC ..... 220/254.3; 220/711; 220/367.1

(58) Field of Classification Search
USPC ..... 220/254.3, 711, 367.1, 257.1, 254.1, 220/713, 717, 718, 375, 255, 845, 847, 220/254.7, 254.2; 229/404
See application file for complete search history.

(56) References Cited

U.S. PATENT DOCUMENTS

| | | | |
|---|---|---|---|
| 1,237,228 | A | 8/1917 | Westover |
| 2,757,824 | A | 8/1956 | Savary |
| 2,851,203 | A | 9/1958 | Nowak |
| 2,886,218 | A | 5/1959 | Marcus |
| 3,031,111 | A | 4/1962 | Stull |
| 3,262,612 | A | 7/1966 | Tabor |
| 3,281,024 | A | 10/1966 | Henchert et al. |
| 3,302,858 | A | 2/1967 | Miller |
| 3,307,752 | A | 3/1967 | Anderson |
| 3,685,517 | A | 8/1972 | Reynolds et al. |
| 3,690,514 | A | 9/1972 | Wilson |
| 3,850,337 | A | 11/1974 | Parks |
| 3,994,411 | A | 11/1976 | Elfelt et al. |
| 4,132,225 | A | 1/1979 | Whattam |
| 4,138,033 | A | 2/1979 | Payne et al. |
| 4,164,303 | A | 8/1979 | Waterbury |
| 4,183,443 | A | 1/1980 | DeParales et al. |
| 4,202,459 | A | 5/1980 | DeParales et al. |
| 4,203,528 | A | 5/1980 | Hasegawa |
| 4,232,797 | A | 11/1980 | Waterbury |

(Continued)

FOREIGN PATENT DOCUMENTS

| | | |
|---|---|---|
| BE | 1007962 | 11/1995 |
| CH | 393955 | 6/1965 |

(Continued)

*Primary Examiner* — J. Gregory Pickett
*Assistant Examiner* — James Way
(74) *Attorney, Agent, or Firm* — McGarry Bair

(57) ABSTRACT

The invention is a recloseable lid for a drinking cup comprising a cap with a dispensing aperture through which liquid can pass. A plug is movably mounted to the cap and is sized to seal the dispensing aperture when a portion of the plug is inserted into the dispensing aperture.

47 Claims, 25 Drawing Sheets

(56) References Cited

U.S. PATENT DOCUMENTS

| | | | | |
|---|---|---|---|---|
| 4,244,488 | A | | 1/1981 | Fridl et al. |
| 4,253,582 | A | | 3/1981 | Shields |
| 4,322,015 | A | | 3/1982 | Bailey |
| 4,331,255 | A | | 5/1982 | Fournier |
| 4,333,583 | A | | 6/1982 | Montemarano |
| 4,345,695 | A | | 8/1982 | Galloway et al. |
| 4,347,946 | A | | 9/1982 | Nichols |
| 4,350,260 | A | | 9/1982 | Prueher |
| 4,361,249 | A | | 11/1982 | Tuneski et al. |
| 4,420,092 | A | | 12/1983 | Finkelstein |
| 4,441,624 | A | | 4/1984 | Sokolowski |
| 4,449,640 | A | | 5/1984 | Finkelstein |
| 4,460,103 | A | | 7/1984 | Rama et al. |
| 4,478,346 | A | | 10/1984 | Spong |
| 4,503,992 | A | | 3/1985 | Sitko et al. |
| D278,312 | S | | 4/1985 | Cleevely et al. |
| 4,516,689 | A | | 5/1985 | Barker |
| 4,557,398 | A | | 12/1985 | Hambleton et al. |
| 4,570,817 | A | | 2/1986 | Hambleton et al. |
| 4,582,216 | A | | 4/1986 | Byrd |
| 4,615,459 | A | | 10/1986 | Clements |
| 4,619,372 | A | | 10/1986 | McFarland |
| 4,629,088 | A | | 12/1986 | Durgin |
| 4,703,873 | A | | 11/1987 | Geren |
| 4,705,197 | A | | 11/1987 | Gordon et al. |
| 4,738,373 | A | | 4/1988 | DeParales |
| 4,741,450 | A | | 5/1988 | Braude |
| 4,753,365 | A | | 6/1988 | Seppala |
| 4,760,934 | A | | 8/1988 | Netsch |
| 4,770,325 | A | | 9/1988 | Gordon et al. |
| 4,782,975 | A | | 11/1988 | Coy |
| 4,796,774 | A | | 1/1989 | Nabinger |
| 4,863,051 | A | | 9/1989 | Eibner et al. |
| 4,869,389 | A | | 9/1989 | Cerrone, Jr. |
| 4,874,103 | A | | 10/1989 | Quisenberry et al. |
| 4,881,668 | A | * | 11/1989 | Kitterman et al. ..... 222/482 |
| 4,899,902 | A | | 2/1990 | DeMars |
| 4,930,654 | A | | 6/1990 | Thibeault et al. |
| 4,932,555 | A | | 6/1990 | La Barge |
| 4,949,865 | A | | 8/1990 | Turner |
| 4,953,743 | A | | 9/1990 | Dart et al. |
| 4,961,510 | A | | 10/1990 | Dvoracek |
| D319,017 | S | | 8/1991 | Turner et al. |
| 5,054,640 | A | | 10/1991 | Tucker |
| 5,062,542 | A | | 11/1991 | Morton |
| 5,088,614 | A | | 2/1992 | Dumestre |
| 5,090,584 | A | | 2/1992 | Roberts et al. |
| 5,110,002 | A | | 5/1992 | Tucker |
| 5,111,961 | A | | 5/1992 | Van Melle |
| 5,148,936 | A | | 9/1992 | DeGrow |
| 5,183,172 | A | | 2/1993 | Boller |
| 5,197,624 | A | | 3/1993 | Dodaro |
| 5,253,781 | A | | 10/1993 | Van Melle et al. |
| D346,718 | S | | 5/1994 | Timmermans |
| 5,366,109 | A | | 11/1994 | Proshan |
| 5,392,949 | A | | 2/1995 | McKenna |
| 5,398,843 | A | | 3/1995 | Warden et al. |
| 5,415,312 | A | | 5/1995 | Mueller |
| D363,671 | S | | 10/1995 | Mueller |
| 5,485,938 | A | | 1/1996 | Boersma |
| 5,490,609 | A | | 2/1996 | Lane et al. |
| D368,624 | S | | 4/1996 | Forrer |
| 5,503,289 | A | | 4/1996 | Fox |
| 5,509,568 | A | | 4/1996 | Warden et al. |
| 5,538,156 | A | | 7/1996 | Proshan |
| 5,588,561 | A | | 12/1996 | Ness |
| 5,613,619 | A | | 3/1997 | Van Melle |
| 5,699,927 | A | | 12/1997 | Lane et al. |
| 5,706,972 | A | | 1/1998 | Sousa |
| 5,718,353 | A | | 2/1998 | Kanfer et al. |
| 5,753,289 | A | | 5/1998 | Ness |
| 5,775,205 | A | | 7/1998 | Melton |
| 5,839,601 | A | | 11/1998 | Van Melle |
| 5,911,311 | A | | 6/1999 | Hutchins |
| 5,913,964 | A | | 6/1999 | Melton |
| 5,947,319 | A | | 9/1999 | Sinski |
| 5,947,323 | A | | 9/1999 | Freek et al. |
| 5,984,127 | A | | 11/1999 | Fenton |
| 5,996,837 | A | | 12/1999 | Freek et al. |
| 6,029,843 | A | * | 2/2000 | Kroscher et al. ..... 220/367.1 |
| 6,079,588 | A | | 6/2000 | Khafizov |
| 6,089,397 | A | | 7/2000 | Van Melle |
| 6,095,033 | A | | 8/2000 | Melton |
| 6,138,854 | A | | 10/2000 | Kaneko et al. |
| D437,223 | S | | 2/2001 | Coy et al. |
| 6,216,904 | B1 | | 4/2001 | Cagan |
| 6,220,470 | B1 | | 4/2001 | McHenry et al. |
| 6,260,727 | B1 | | 7/2001 | Durdon |
| 6,299,012 | B1 | | 10/2001 | Redmond |
| 6,305,571 | B1 | | 10/2001 | Chu |
| 6,315,145 | B1 | | 11/2001 | Fask et al. |
| 6,364,101 | B1 | | 4/2002 | Schultz |
| 6,374,726 | B1 | | 4/2002 | Melton |
| 6,419,105 | B1 | | 7/2002 | Bruce et al. |
| 6,431,390 | B1 | | 8/2002 | Waller |
| 6,523,712 | B1 | | 2/2003 | McGushion |
| 6,578,726 | B1 | | 6/2003 | Schaefer |
| 6,612,456 | B1 | | 9/2003 | Hundley et al. |
| 6,644,490 | B2 | | 11/2003 | Clarke |
| 6,679,397 | B2 | * | 1/2004 | Smith et al. ..... 220/254.1 |
| 6,905,044 | B1 | * | 6/2005 | Russo et al. ..... 220/719 |
| 2002/0027139 | A1 | | 3/2002 | O'Neill |
| 2002/0170912 | A1 | | 11/2002 | Clarke |
| 2003/0024930 | A1 | | 2/2003 | Smith et al. |
| 2003/0141302 | A1 | | 7/2003 | Ryan et al. |

FOREIGN PATENT DOCUMENTS

| | | | |
|---|---|---|---|
| DE | 29502654 | | 7/1995 |
| EP | 0383442 | | 8/1990 |
| FR | 1402431 | | 6/1965 |
| FR | 2736620 | | 1/1997 |
| GB | 1600917 | | 10/1981 |
| GB | 2206106 | | 12/1988 |
| GB | 2264858 | | 9/1993 |
| JP | 55187192 | | 7/1982 |
| JP | 07309379 | | 11/1995 |
| JP | 9175553 | | 7/1997 |
| JP | 2000159254 | | 6/2000 |
| JP | 2001130613 | | 5/2001 |
| WO | 9303973 | | 3/1993 |
| WO | 9514618 | | 6/1995 |
| WO | 9947429 | | 9/1999 |
| WO | 0051908 | | 9/2000 |
| WO | 02092451 | A1 | 11/2002 |

* cited by examiner

RECLOSEABLE LID WITH CLOSURE PLUG

RELATED PATENT APPLICATIONS

This application is a continuation of U.S. patent application Ser. No. 10/065,722, filed Nov. 13, 2002. This application also claims priority on U.S. provisional patent application Ser. No. 60/350,706 filed Nov. 13, 2001, U.S. provisional patent application Ser. No. 60/350,875 filed Jan. 22, 2002, and U.S. provisional patent application Ser. No. 60/410,380 filed Sep. 13, 2002. All of the above-identified priority applications are expressly incorporated herein by reference.

BACKGROUND OF THE INVENTION

1. Field of the Invention

The invention relates to a recloseable lid for use with a drinking cup. In one aspect, the invention relates to a recloseable lid with a removable plug assembly which is operable between an open position, where a user can consume the contents of the cup, and a closed position, where the contents of the cup are inhibited from spilling. In another aspect, the recloseable lid assembly is suitable for disposable use, especially in the fast-food or take-out food market.

2. Description of the Related Art

Disposable cups with lids that inhibit spilling while allowing consumption of the liquid contained therein are well known in the industry. One type of lid incorporates a series of narrowly spaced baffled slots through which the liquid can be consumed. The narrow spacing of the slots and the baffles minimizes but does not eliminate spillage while allowing the liquid to be consumed. Another type of lid incorporates a flap that can be torn back from the rim of the cup toward the center of the lid and is secured in an open position to provide a drinking aperture. The lid can be re-closed by reattaching the flap to the rim of the cup. However, while these cups have the benefit of being disposable and relatively spill-proof during consumption, these lids are not resealable and liquid can be spilled when the consumer is not drinking from the cup.

There are non-disposable, recloseable lids that can be used with non-disposable cups that can inhibit spilling such as during the normal operation of a motor vehicle. One such recloseable lid comprises a well that is sized to be received within the opening of the cup. Multiple O-rings are disposed about a peripheral wall of the well and contact the cup to form a fluid-seal therebetween. A bottom wall of the well has a through opening permitting the passage of fluids from the cup. A rotatable cover is positioned within the well against the bottom wall and includes a projection and a through opening. When the through openings of the well and the cover align, a consumer can drink the contents from the cup. When the projection is received within the well through opening, the cup is closed.

The recloseable well structure is advantageous in that the lid can be closed to inhibit spilling and to the extent fluid is spilled it can be retained in the well. The lid is disadvantageous in that the well structure extends into the cup, which reduces the cup liquid capacity. The lid is also not suitable for use as a disposable lid in the fast-food or take-out food market because of its apparent manufacturing complexity, which requires the use of injection molding techniques.

Another group of non-disposable lids are injection molded lids with a drink opening in combination with an attached plug or cap for closing the drink opening. In some cases, the plug is separately molded and mechanically fixed to the lid by a cooperating projection molded into the lid. In other cases, the plug has a rivet-like projection that extends through an opening molded in the lid.

The nature of the injection molding process makes these lids unsuitable for disposable use because of the relatively high cost. Disposable lids are typically fabricated from thermoforming due to lower fabrication costs and higher production rates. Injection molded lids generally use a much greater amount of material and have a greater thickness than thermoformed lids. The additional material and thickness is well suited for non-disposable lids, but adds additional and unnecessary cost for a disposable lid where only a one-time use is anticipated.

However, the injection molding process is more suitable for making lids with complex shapes and strong connection/support structures, without a lot of material waste. The injection mold defines a three-dimensional cavity that is filled with molten plastic to form the lid. The mold can be made to accommodate almost any desired three-dimensional shape. However, the thermoforming process uses an effectively two-dimensional sheet of material that is pressed around a form. For example, a recloseable lid having an integral closure device extending from the lid upper surface can be easily formed by injection molding. However, such a lid cannot be formed with the thermoforming process, unless the integral closure is formed by tearing-away a portion of the lid upper surface, because both the lid and closure device must be made from the same portion of the sheet.

The distinction between injection molding and thermoforming can be thought of as the injection molding process can form pieces having varying thickness whereas the thermoforming process can only make parts having a thickness equal to, or due to stretching, less than, the thickness of the sheet material. Therefore, while the injection molding process can have increased thickness portions, such as webs, gussets, and the like, no such increased thickness portion can be made with the thermoforming process.

The ability of the injection mold to be crafted to handle complex designs is disadvantageous when it comes to production rates. The mold must be closed, filled with molten plastic, which then must be cooled sufficiently to retain its shape prior to the opening of the mold. In contrast, the thermoforming process uses a web of plastic that is heated to or beyond its glass state, which permits the web to be shaped but does not require a long cooling time as does the injection mold system. Thus, the thermoformed web is shaped and advanced to the next production step much faster than with the injection mold. The end result is that the thermoforming process has much higher production rates.

There is a desire for a recloseable lid that is easy and inexpensive to manufacture, preferably by using the thermoforming process, while still being able to maintain a seal after multiple cycles between the open and closed positions. Preferably, the recloseable lid would have a removable closure device and be suitable for disposable use in the fast-food or take-out food market. Previously, only injection molded lids could obtain this functionality. However, they were too expensive for high volume disposable use.

SUMMARY OF THE INVENTION

The invention is a recloseable lid suitable for disposable use and comprises a cap with a drink opening that is sealed by a drink plug. In one embodiment, the lid comprises a cap sized to overlie and substantially cover the open top of a cup and having a drink opening and a mounting recess formed therein. A mounting ring connects the cap to a cup by the receipt of the cup rim in a peripheral channel formed by the mounting ring. The lid further comprises a tab closure comprising a mounting plug and a drink plug connected by a stem. The mounting plug is sized to be received within the mounting recess, and the drink plug is sized to be received within the drink opening wherein the user can open and close the lid by removing or inserting the drink plug from the drink opening.

In another embodiment the invention relates to a disposable, recloseable lid comprising a cap sized to overlie and substantially cover the open top of a cup and having a drink opening formed therein. The lid further comprises a mounting ring connected to the cap and defining a peripheral channel sized to receive the rim of a cup for mounting the cap to a cup. A tab closure is provided and comprises a stem and a drink plug, the stem extending from one of the mounting ring and cap and having a length sufficient to permit the drink plug to overlie the drink opening. The drink plug is sized to be received within the drink opening to close the drink opening. The user can open and close the lid by removing or inserting the drink plug from the drink opening, and the cap, mounting ring, and tab are formed from a plastic sheet and have a substantially uniform thickness.

The tab closure can be fixedly or removably mounted to the mounting ring or cap. The lid can also include a tab closure holder for holding the tab closure in the open position so it is out of the way of a user drinking from the lid.

The cap can have a variety of shapes. It can be generally flat or have a dome-shape configuration. In the dome-shape configuration, a wall is provided that extends above an upper surface. The drink opening is formed in the wall and the recess is formed in the upper surface. The width of the wall adjacent the ends of the drink opening can have a reduced width.

DESCRIPTION OF THE PREFERRED EMBODIMENTS

Figure 1:
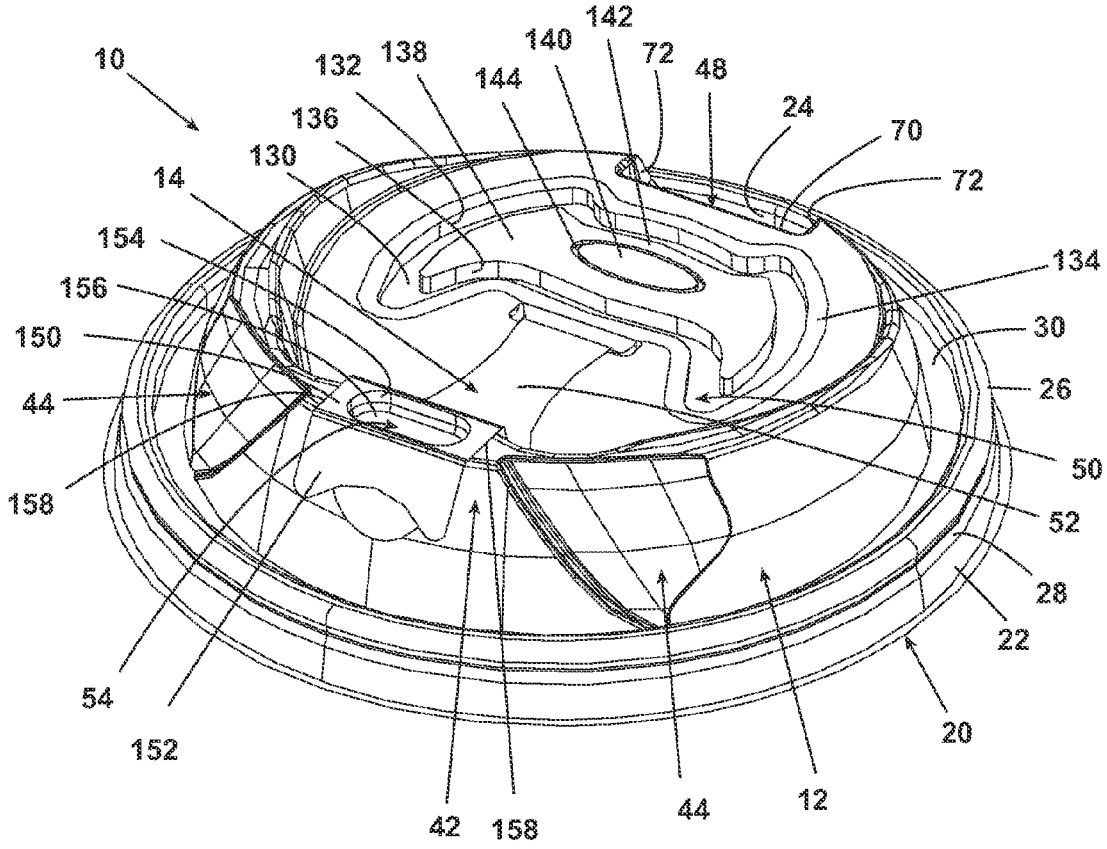
FIG. 1 is a top perspective view of a first embodiment recloseable lid according to the invention comprising a cap with a removable tab closure shown in a closed position.
Figure 1A:
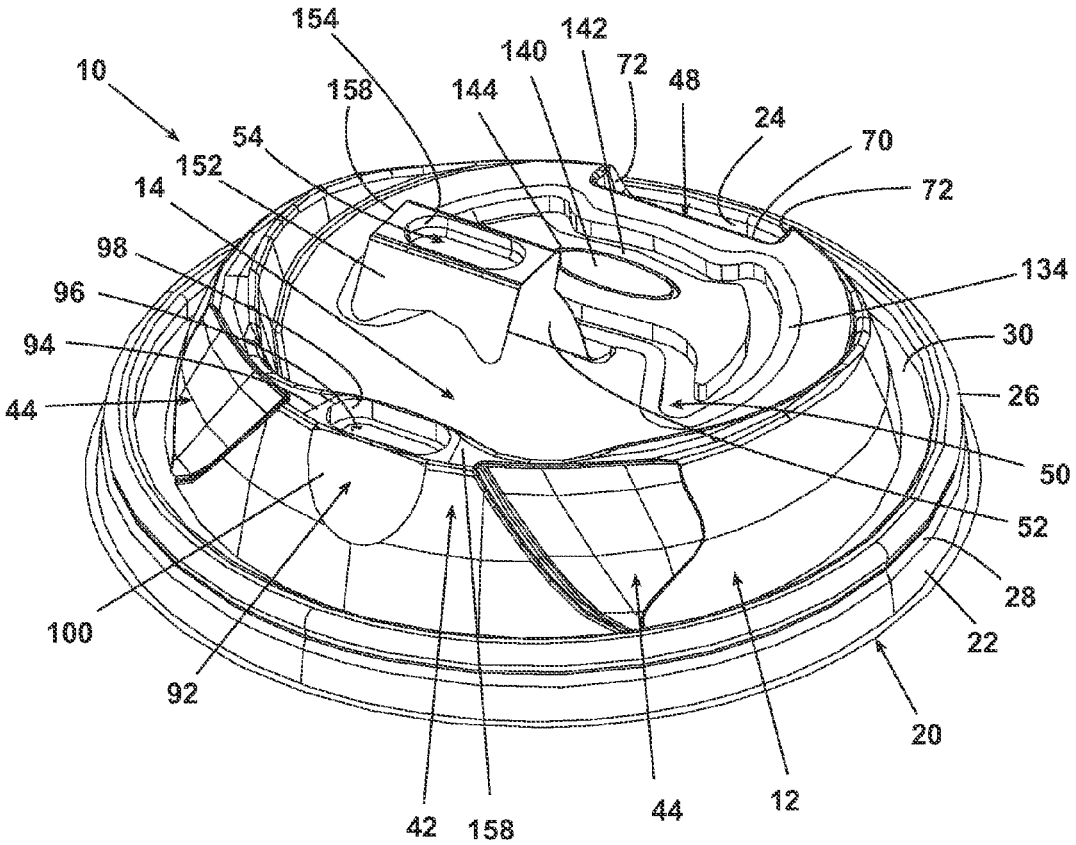
FIG. 1A is a top perspective view of the first embodiment recloseable lid according to the invention shown with the removable tab closure in a partially open position.
Figure 1B:
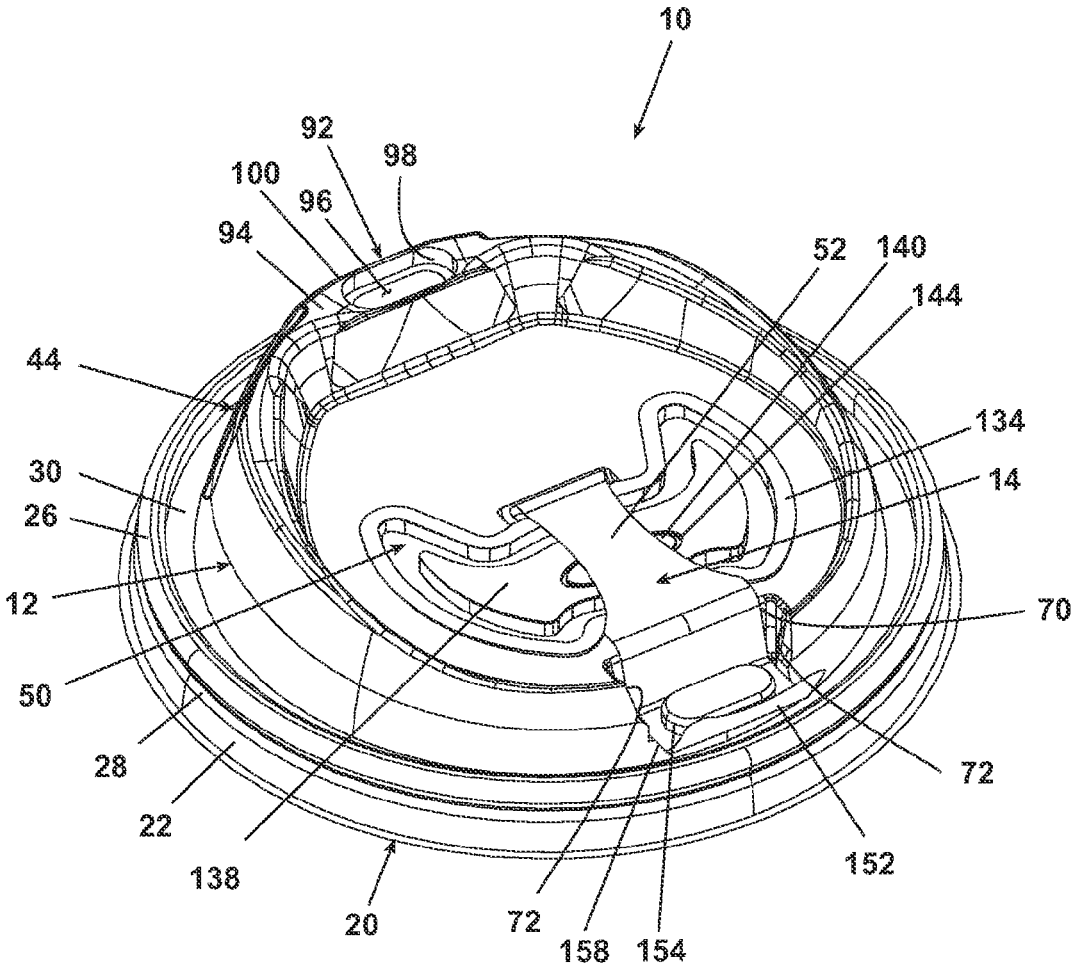
FIG. 1B is a top perspective view of the first embodiment recloseable lid according to the invention shown with the removable tab closure in a fully open position.

Referring now to FIGS. 1-5, a recloseable lid 10 comprises a cap 12 and a plug assembly 14. In the preferred embodiment, the recloseable lid 10 is fabricated of a flexible, thin-walled plastic by a conventional thermoforming process. The recloseable lid 10 is adapted for removable attachment to a disposable container (not shown), such as a foam cup. The recloseable lid 10 is attached to the container by a conventional cup mount 20 well-known in the industry. As shown in FIG. 1, the cup mount 20 comprises an annular skirt 22 depending exteriorly from an annular top wall 26. An annular inner wall 24 depends from the top wall 26 in spaced-apart juxtaposition from the annular skirt 22 for insertion over the rim of the disposable container. An annular rib 28 extends inwardly of the annular skirt 22 for gripping the rim of the disposable container. Extending further inwardly from the annular inner wall 24 is an annular floor 30.

The cap 12 comprises a planar dome floor 40, a drink opening 42 extending upwardly from the floor 40 and transitioning on either side to a buttress 44. Extending below the plane of the dome floor 40 is a reservoir 46, which, in the preferred embodiment, is wing-shaped. However, other reservoir shapes can be used. Located diametrically opposite the drink opening 42 is a plug retainer 48. The plug assembly 14 comprises a generally wing-shaped mounting plug 50, a strap 52, and a dispensing aperture plug 54. Although the mounting plug 50 in the preferred embodiment is wing-shaped, other shapes can be used for the mounting plug 50 compatible with the shape of the reservoir 46. The planar dome floor 40 is provided with a hinge trough 60 adjacent the reservoir 46 intermediate the reservoir 46 and the drink opening 42.

Figure 6:
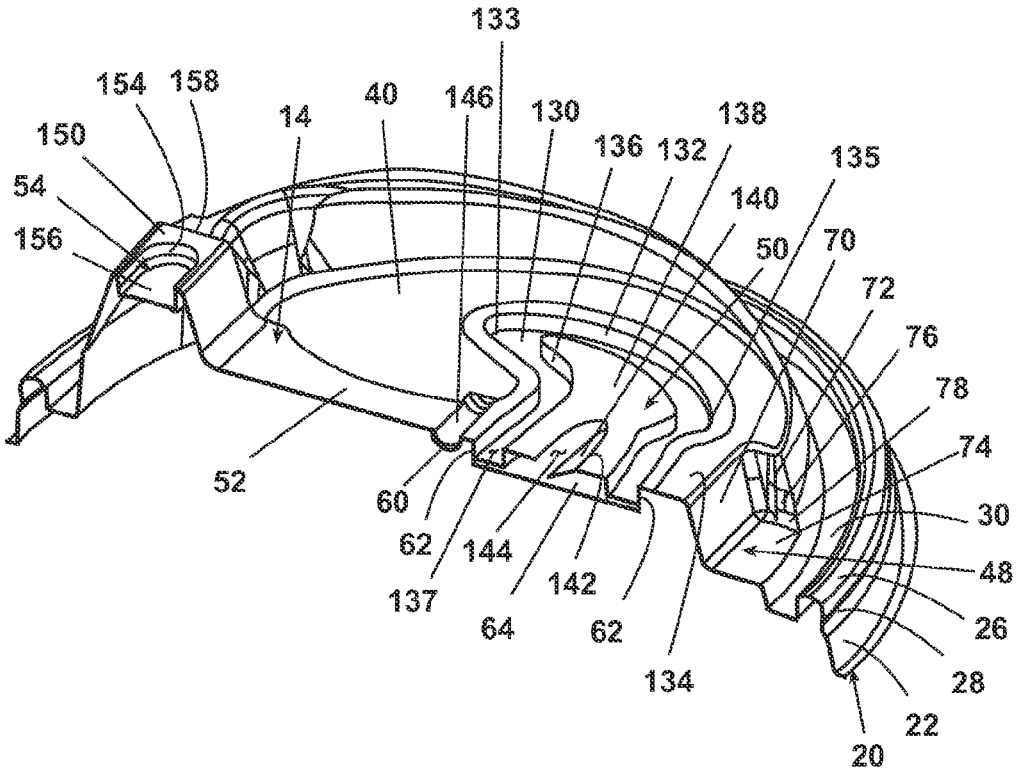
FIG. 6 is a sectional view of the first embodiment recloseable lid according to the invention shown in FIG. 5 taken along line 6-6.
Figure 6A:
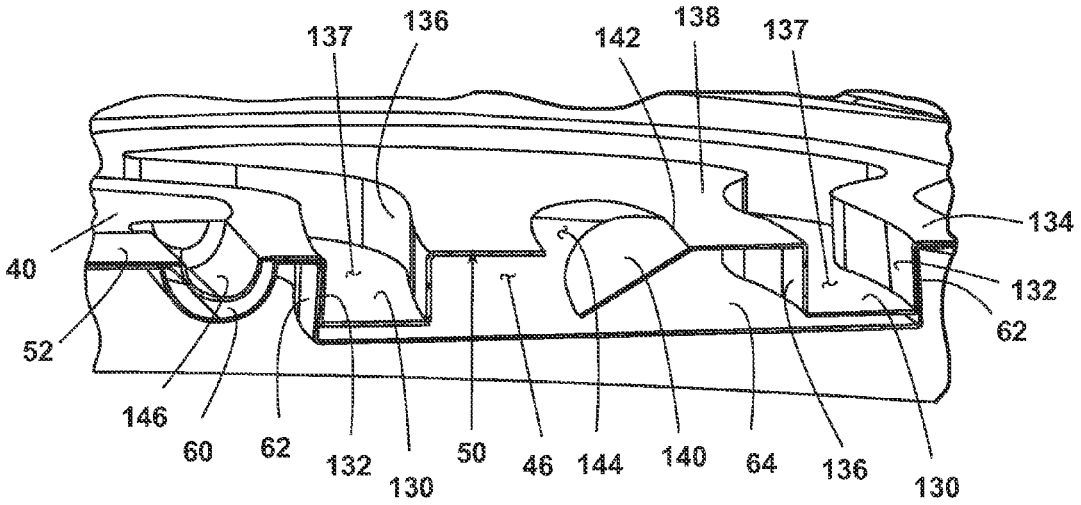
FIG. 6A is a close-up view of a portion of the sectional view shown in FIG. 6 of the first embodiment recloseable lid according to the invention.

The reservoir 46 in the preferred embodiment is a generally wing-shaped cavity comprising a reservoir wall 62 depending from the dome floor 40. As shown in FIG. 6A, the reservoir wall 62 is inclined somewhat outwardly from the dome floor 40 to form an undercut relative to the dome floor 40. Preferably, the angle of inclination of the reservoir wall 62 from a line normal to the dome floor 40 is negative 4°, and the height of the reservoir wall 62 is preferably 0.100 inches. The reservoir wall 62 terminates in a reservoir floor 64 in generally parallel, spaced-apart juxtaposition with the dome floor 40. A reservoir vent 66, shown in FIGS. 2-4 as a generally circular aperture, extends through the reservoir floor 64 for venting of the interior of the disposable container when the recloseable lid 10 is mounted thereto. The preferred location of the vent 66 is described hereinafter.

The plug retainer 48 is a somewhat rectilinear cavity in diametric juxtaposition with the drink opening 42, which comprises a plug retainer inner wall 70 depending generally orthogonally from the dome floor 40 and terminating in a plug retainer floor 74. The plug retainer 48 is also provided with a pair of plug retainer side walls 72 in spaced-apart, generally parallel juxtaposition joining the plug retainer inner wall 70 and the plug retainer floor 74. The plug retainer side walls 72 are provided with a pair of inwardly-extending bosses 76 which define a pair of notches 78 intermediate the bosses 76 and the plug retainer floor 74.

The drink opening 42 is a thin-walled hollow structure extending upwardly from the planar dome floor 40 at the circumference thereof, which comprises a drink opening inner wall 90 in spaced-apart juxtaposition from a drink opening peripheral wall 92. The drink opening inner wall 90 and the drink opening peripheral wall 92 terminate in a drink opening top wall 94 having a dispensing aperture 96 extending therethrough, shown in FIG. 4 as having a generally oval shape. The dispensing aperture 96 is defined by an opening peripheral wall 98 depending generally negative 4° from the drink opening top wall 94 to terminate in the dispensing aperture 96. The drink opening peripheral wall 92 has a planar section 100 having a generally arcuate perimeter extending downwardly from the drink opening top wall 94. The drink opening 42 transitions to a pair of juxtaposed buttresses 44 through a pair of inclined walls 104 extending inwardly from the drink opening peripheral wall 92 along opposing inclined edges 102.

Figure 2:
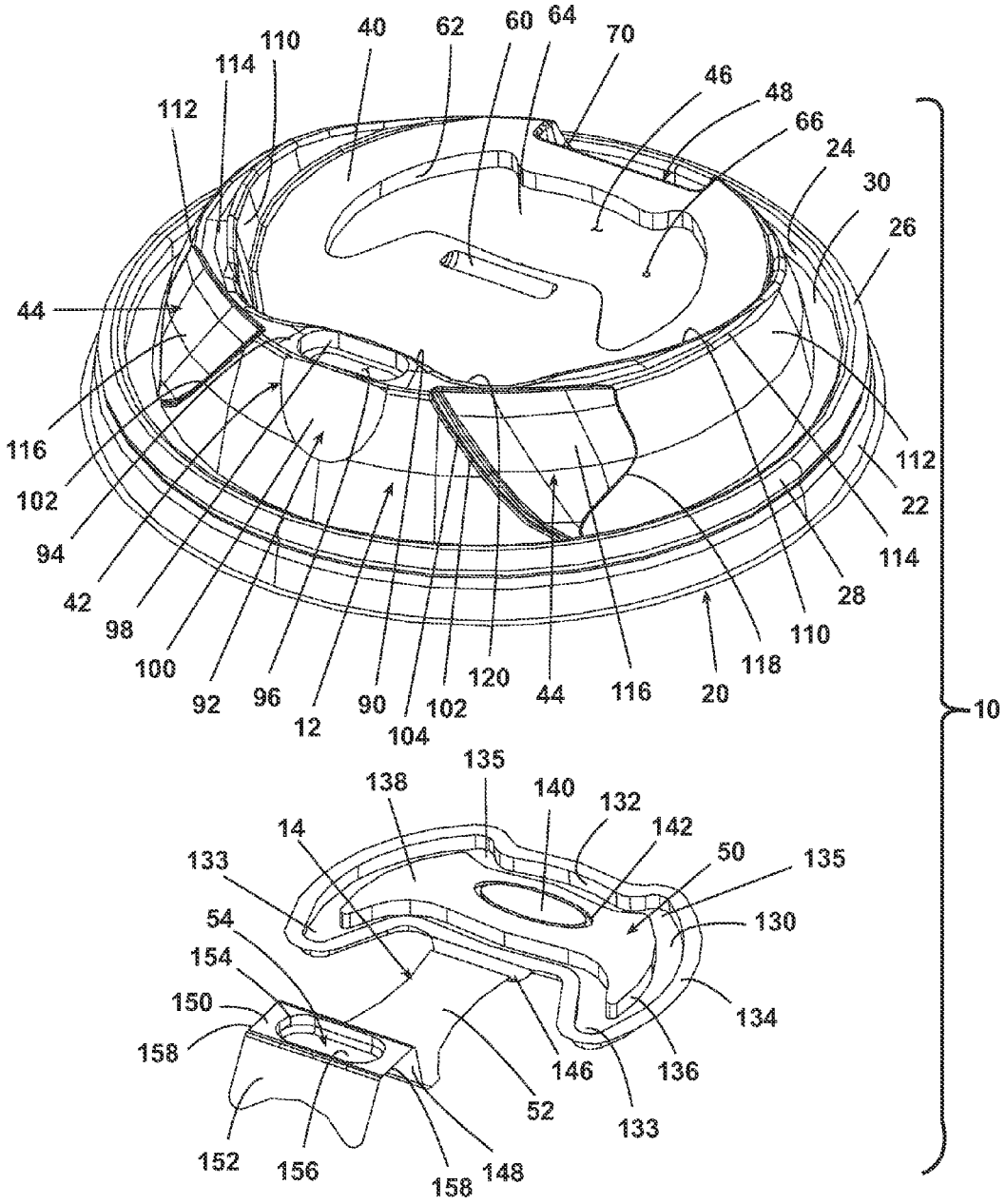
FIG. 2 is a top perspective view of the first embodiment recloseable lid according to the invention with the removable tab closure separated from the cap.
Figure 3:
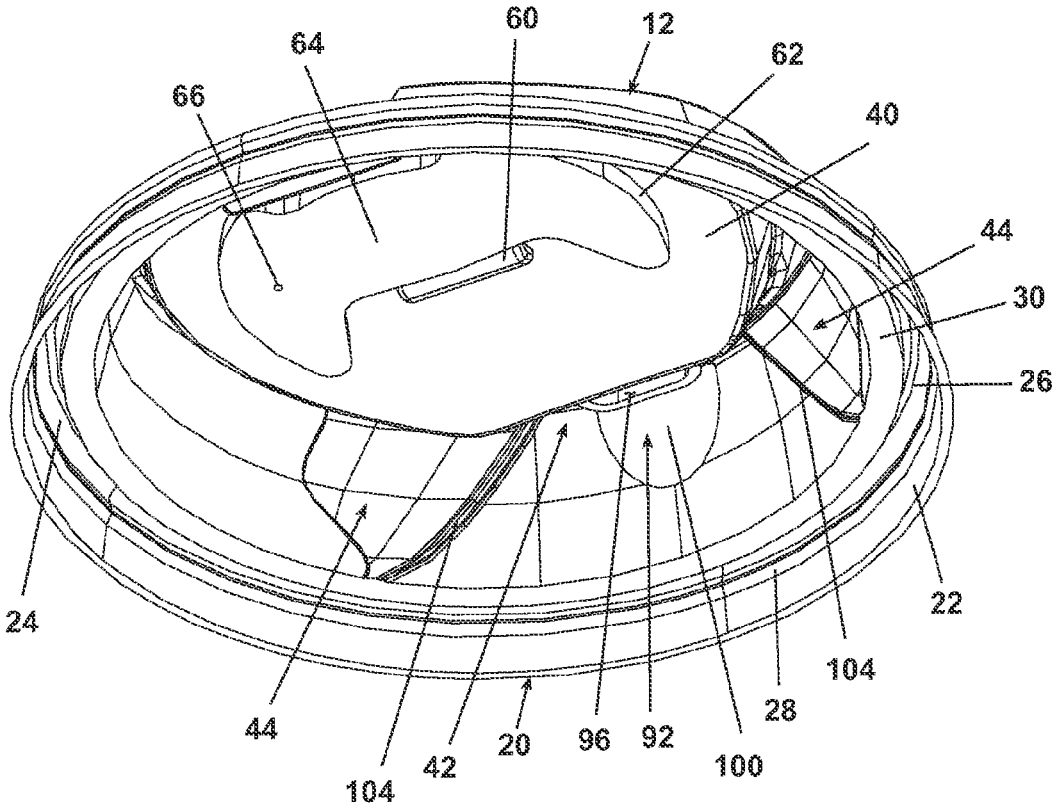
FIG. 3 is a bottom perspective view of the first embodiment recloseable lid according to the invention.
Figure 4:
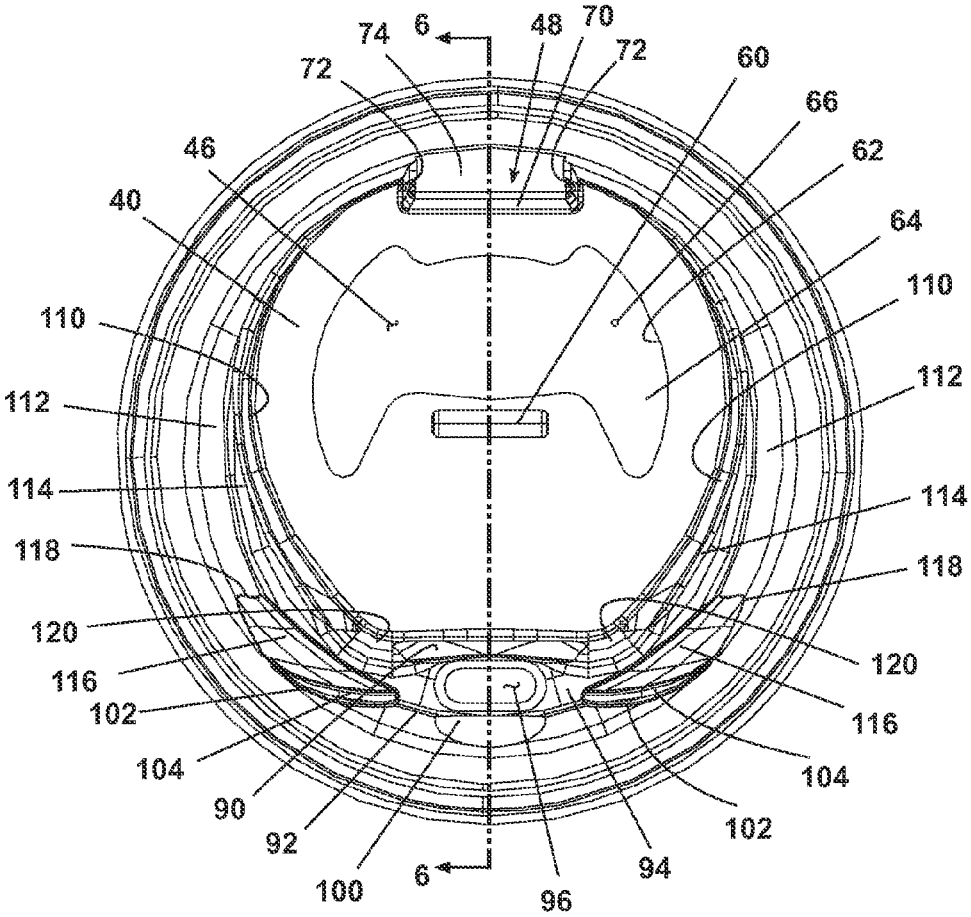
FIG. 4 is a top plan view of the first embodiment recloseable lid according to the invention with the removable tab closure separated from the cap.

The inclined walls 104 terminate at buttress peripheral walls 112 extending away from the drink opening 42 circumferentially along the planar dome floor 40. The peripheral walls 112 have positive draft angles as illustrated in FIG. 2. The buttresses 44 also comprise a pair of buttress inner walls 110 in spaced-apart juxtaposition to the buttress peripheral walls 112. Both the buttress peripheral walls 112 and the buttress inner walls 110 gradually decrease in height from the drink opening 42 to terminate at the planar dome floor 40 adjacent to the plug retainer 48. Extending between the buttress inner walls 110 and the buttress peripheral walls 112 are buttress top walls 114 inclined generally downwardly to intersect the dome floor 40 adjacent to the plug retainer 48. The buttress peripheral wall 112 transitions at a transition line 118 to a relief surface 116 extending on either side of the drink opening 42. The buttress inner walls 110 transition to the drink opening inner wall 90 along a pair of arcuate-shaped flared portions 120.

Figure 5:
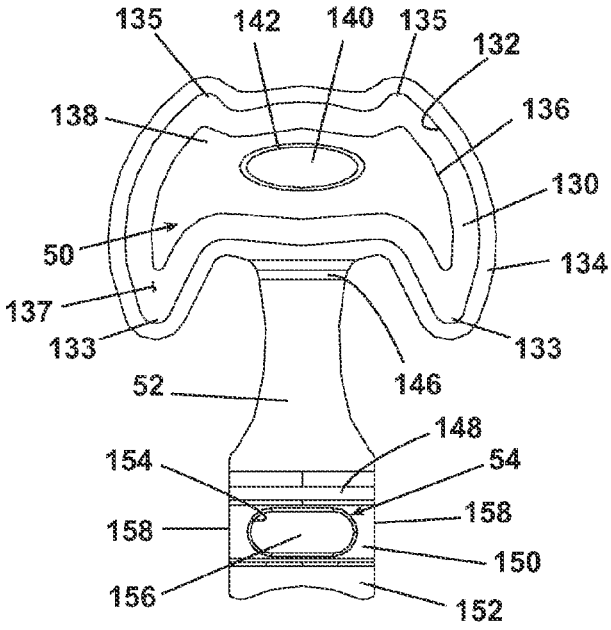
FIG. 5 is a top plan view of the removable tab closure of the first embodiment recloseable lid according to the invention.

The preferred embodiment of the mounting plug 50 comprises a generally flattened, wing-shaped structure comprising a mounting plug bottom wall 130 transitioning to an orthogonally upwardly-extending mounting plug peripheral wall 132 adapted to be received in the reservoir 46. As shown in FIG. 5, the wing-like shape of the mounting plug 50 defines a pair of spaced-apart primary tips 133 extending toward the dispensing aperture plug 54 and a pair of spaced-apart secondary tips 135 extending away from the dispensing aperture plug 54. As shown in FIG. 6A, the peripheral wall 132 is somewhat outwardly inclined for snap-fit communication with the outwardly inclined reservoir wall 62. Preferably, the angle of inclination of the peripheral wall 132 from a line normal to the bottom wall 130 is negative 4°. The mounting plug peripheral wall 132 terminates in a peripheral flange 134 extending orthogonally thereto and adapted for contact with the planar dome floor 40. Extending orthogonally upwardly from the mounting plug bottom wall 130 is a generally wing-shaped mounting plug inner wall 136 terminating in a mounting plug top wall 138 in generally parallel, spaced-apart juxtaposition to the mounting plug bottom wall 130. The mounting plug peripheral wall 132, the mounting plug bottom wall 132, and the mounting plug inner wall 136 define a channel 137 extending along the perimeter of the mounting plug 50. A portion of the mounting plug top wall 138 is adapted to form a vent flap 140 attached to the mounting plug top wall 138 along a living hinge 142 to form a flapped vent 144. Preferably, the height of the mounting plug peripheral wall 132 is 0.085 inches so that the difference in height of the peripheral wall 132 and the reservoir wall 62 is 0.015 inches.

Extending longitudinally away from the mounting plug 50 intermediate the primary tips 133 is a strap 52 comprising a strap hinge 146 which hingedly connects the strap 52 to the mounting plug 50. The strap 52 terminates at an upwardly extending connecting portion 148 which terminates in a plug portion 150 which, in turn, terminates in a pull tab 152. The plug portion 150 comprises the dispensing aperture plug 54 comprising a circumferential, downwardly-extending plug wall 154 terminating in a plug floor 156. Preferably, the plug wall 154, like the reservoir wall, also has a negative 4° draft. The plug 54 is adapted for frictional communication with the dispensing aperture 96. The plug portion 150 terminates along a lateral portion in a pair of juxtaposed strap edges 158.

It should be noted that while the preferred draft angle is negative 4°, it is within the scope of the invention for other draft angles to be used. In most cases, draft angles from 0 to −10° are suitable. The surfaces or walls having the draft also need not have a straight profile or cross section as illustrated. For example, the cross section could be saw-toothed or could be a peripheral rib. Referring now to FIGS. 1, 1A, 6 and 6A, the plug assembly 14 is attached to the cap 12 by inserting the mounting plug 50 in the reservoir 46 in a snap-fit engagement. The strap hinge 146 will be received within the hinge trough 60, and the mounting plug 50 will frictionally communicate with the dispensing aperture 96. As can be seen in FIG. 6A, the mounting plug bottom wall 130 will be spaced 0.015 inches above the reservoir floor 64 due to the difference in height between the mounting plug peripheral wall 132 and the reservoir wall 62. As previously described, the reservoir vent 66 extends through the reservoir floor 64. Preferably, the reservoir vent 66 is located in the reservoir floor 64 immediately beneath the plug bottom wall 130. The 0.015-inch gap between the bottom wall 130 and the floor 64 will draw liquid in the reservoir 46 under the channel 137 through capillary action where it will be drained through the vent 66 to the container. The mounting plug top wall 138 will form an enclosed reservoir to prevent further spillage of liquid retained in the reservoir 46.

The reservoir 46 collects liquid that seeps directly from the vent opening 66 or from condensation from vapor escaping through the vent opening 66. Unlike prior lids, the reservoir helps in keeping the top surface of the lid free from liquid. The volume of the reservoir is partly determined by the difference in height between the plug wall height, preferably 0.085 inches, and the reservoir wall height, preferably 0.100 inches, which results in 0.015 gap therebetween. Other dimensional configurations are within the scope of the invention if a different volume is needed or desired.

A different gap height may also be desired based on additional functional determinations. For example, to the extent that it is desired to located the vent opening below the channel 137 to use capillary action to drain the liquid from the reservoir back into the cup, the dimensions between the plug and the reservoir can be any dimension that accomplishes the capillary action. Thus, the gap size can be increased/decreased as needed to control the capillary action.

It is also not necessary to locate the vent opening beneath the channel 137. The vent opening can be located anywhere within the reservoir 46. Further, multiple vent openings could be used if desired, with, for example, one located in the reservoir 46 and another located in the planar dome floor 40. The type of vent opening can also vary. For convenience, it is preferred that the vent opening 66 be a flap formed from the cap 12 and folded back. The flap normally has a triangular shape. However, other types of vent openings could be used.

The large vent opening 144 solves a problem associated with the use of the reservoir to hold the liquid that would otherwise reside on the upper surface of the lid when a standard vent opening is used. As liquid collects in the reservoir, there is a tendency for a film to form across a standard vent opening in the plug, blocking the escape of vapor from the reservoir through the standard vent opening. As more vapor enters the reservoir through the vent opening 66, a bubble can form and extend through the vent opening. When the bubble bursts, it will leave liquid on the exterior of the lid, which is undesirable. The larger vent opening 144 is of a size such that the liquid cannot span the opening or span the gap between the flap 140 and the edge forming the opening 144, eliminating the likelihood that a film can be formed across the vent opening.

A standard vent opening, such as a triangular flap, can be used in place of the vent flap 140. However, such a substitution will result in the loss of the functionality associated with the larger vent opening. Therefore, it is preferred to use the vent flap 140.

The plug 50 can be removed from the dispensing aperture 96 by lifting up on the pull tab 152. The plug assembly 14 can be folded back along the strap hinge 146 so that the plug portion 150 is received in the plug retainer 48. The plug assembly 14 will be retained in the plug retainer 48 by snap fitting the strap edges 158 in the notches 78 as shown in FIGS. 6 and 6A. The plug assembly 14 can be removed from the plug retainer 48 by lifting up on the pull tab 152 to release of the strap edges 158 from the notches 78 to return the plug 50 to the dispensing aperture 96.

The primary tips 133 and the secondary tips 135 prevent removal of the mounting plug 50 from the reservoir 46 when a lifting tension is applied to the strap 52. As the strap 52 is pulled upwardly, such as during removal of the dispensing aperture plug 54 from the dispensing aperture 96, tension in the strap 52 will be transmitted to the center of the mounting plug 50 adjacent the connection of the strap 52 to the mounting plug 50. This will tend to urge the center of the mounting plug 50 upward. The greater the tension, the greater the tendency of the center of the mounting plug 50 to deflect upward. However, this tensile stress will be dissipated through the mounting plug 50 so that the tips 133, 135 will "feel" little or no stress tending to dislodge the tips 133, 135 from their position in the reservoir 46 which will minimize the tendency of the mounting plug 50 to be removed from the reservoir 46. The location of the tips 133, 135 relatively far in front of and behind the point of force application through the strap 52 increases the leverage required to dislodge the tips from the reservoir. Consequently, the mounting plug 50 will remain "locked" into the reservoir 46.

Figure 7:
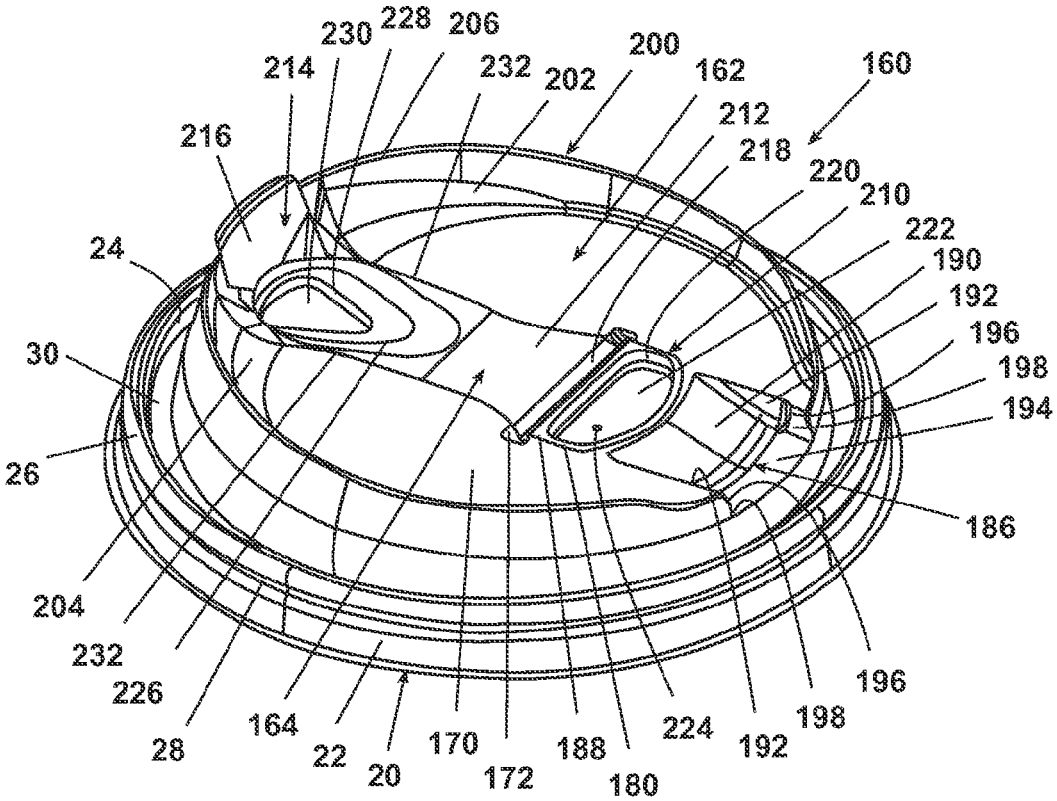
FIG. 7 is a top perspective view of a second embodiment recloseable lid according to the invention comprising a cap with a removable tab closure according to the invention shown in the closed position.
Figure 7A:
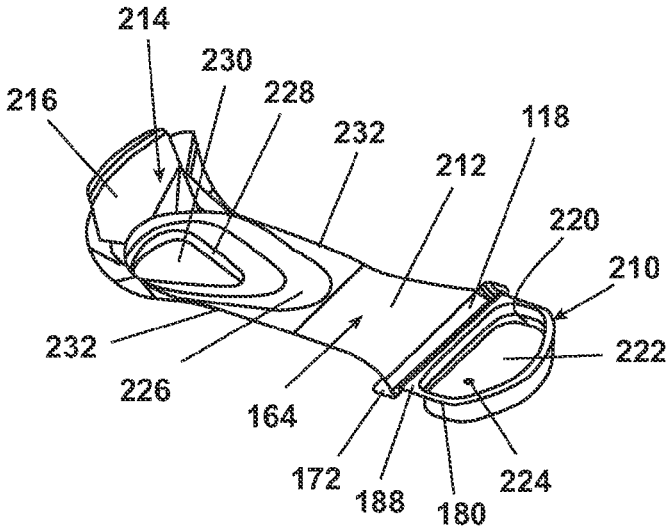
FIG. 7A is a top perspective view of the removable tab closure of the second embodiment recloseable lid according to the invention.
Figure 8:
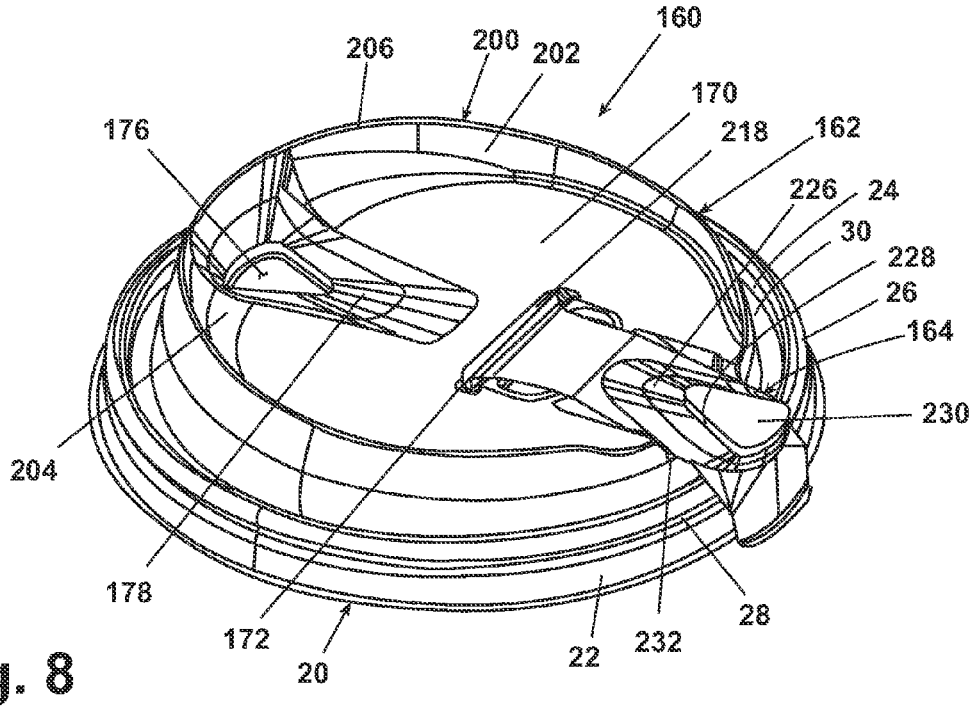
FIG. 8 is a top perspective view of the second embodiment recloseable lid according to the invention shown in the open position.
Figure 8A:
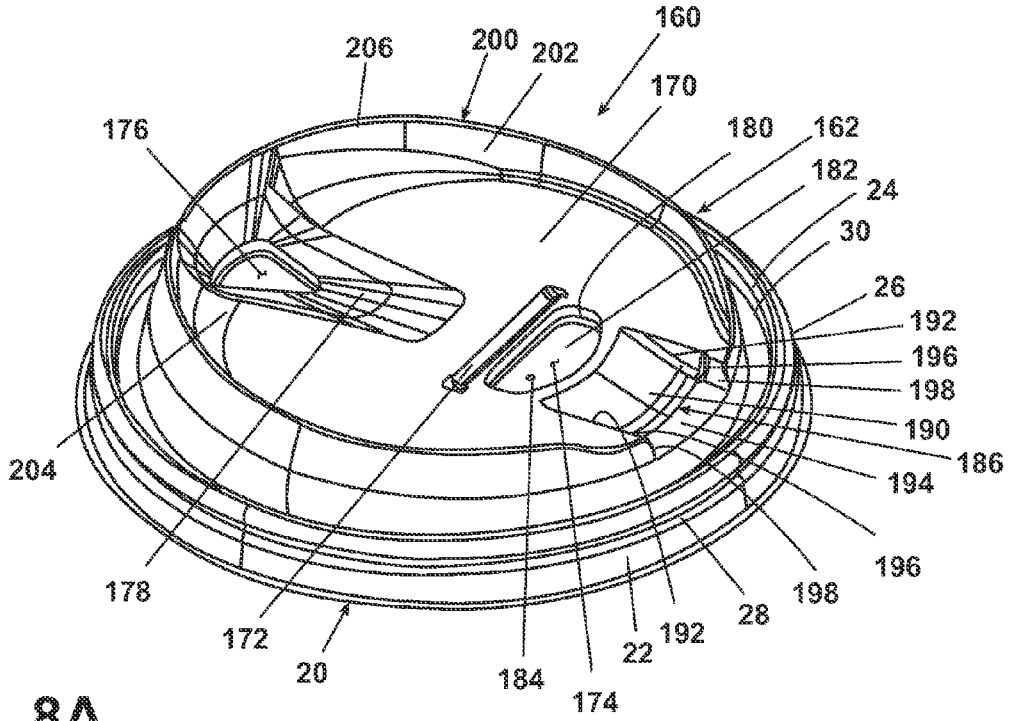
FIG. 8A is a top perspective view of the second embodiment recloseable lid according to the invention with the removable tab closure removed from the cap.
Figure 9:
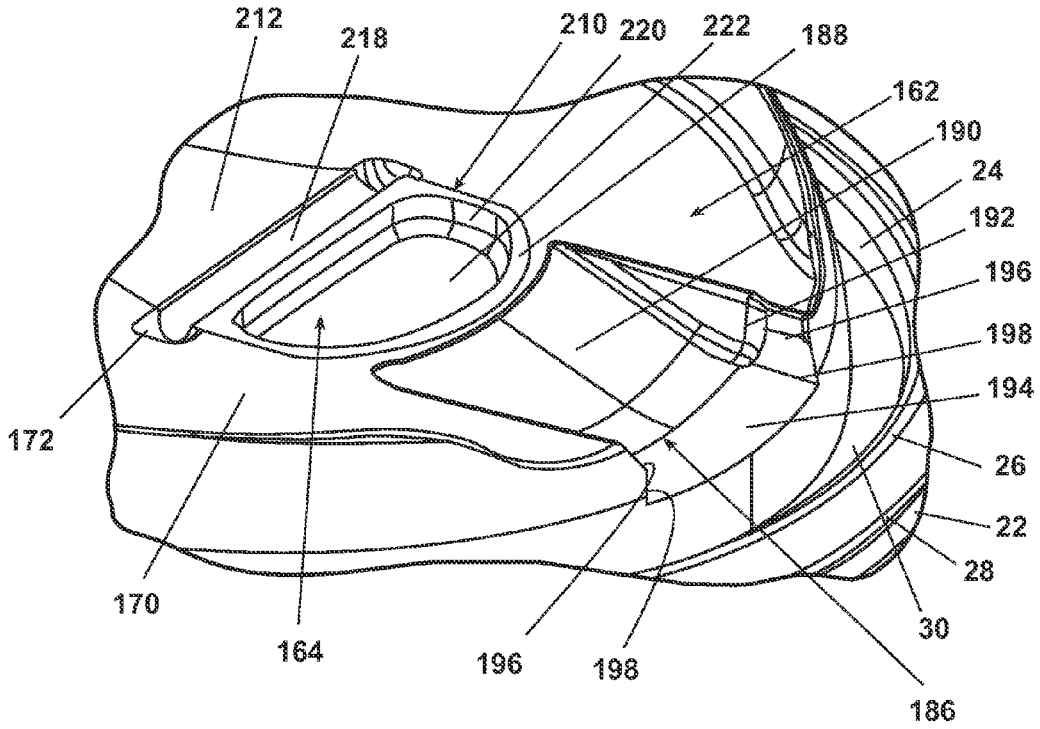
FIG. 9 is a close-up view of a portion of the second embodiment recloseable lid according to the invention showing an attachment of the removable tab closure to the cap.

A second embodiment of a recloseable lid 160 is shown in FIGS. 7-9. The recloseable lid 160 comprises some of the same elements of the recloseable lid 10 and, thus, like numbers are used to identify like elements.

The recloseable lid 160 comprises a cap 162 and a plug assembly 164. The cap 162 comprises a planar dome floor 170 having a hinge trough 172 and a generally D-shaped reservoir 174 formed therein. A dispensing aperture 176 is formed at a peripheral portion of the planar dome floor 170. An inclined floor 178 extends in a downwardly inclined direction from the dome floor 170 to the dispensing aperture 176. The reservoir 174 comprises a reservoir wall 180 depending generally orthogonally downwardly from the dome floor 170 to terminate in a reservoir floor 182 in generally parallel, spaced apart juxtaposition to the dome floor 170. A reservoir vent 184, shown as a generally circular aperture, extends through the reservoir floor 182 in fluid communication with the interior of the recloseable lid 160 and the disposable container (not shown) to which it is attached.

A plug retainer 186 is formed in the cap 162 diametrically opposite the dispensing aperture 176. The plug retainer 186 comprises a plug retainer inner wall 190 inclined downwardly from the dome floor 170 to terminate in a plug retainer floor 194. A pair of generally parallel, spaced-apart plug retainer side walls 192 depend downwardly from the dome floor 170 to join the plug retainer inner wall 190 and the plug retainer floor 194. The plug retainer side walls 192 are provided with a pair of inwardly-extending bosses 196 which define a pair of notches 198 intermediate the bosses 196 and the plug retainer floor 194.

Extending circumferentially above the dual floor 170 on either side of the dispensing aperture 176 is an arcuate peripheral rim 200 comprising an inner wall 202 and an outer wall 204 joining in an arcuate ridge 206. The ridge 206 extends along the periphery of the dome floor 170 away from the dispensing aperture 176 in a downwardly-inclined fashion to terminate on either side of the plug retainer 186.

The plug assembly 164 comprises a generally D-shaped mounting plug 210 attached to a dispensing aperture plug 214 through an intermediate strap 212. The dispensing aperture plug 214 terminates in a lift tab 216. Adjacent the mounting plug 210 is a living hinge 218 intermediate the mounting plug 210 and the dispensing aperture plug 214. The mounting plug 210 is adapted for snap-fit communication with the reservoir 174 and comprises a downwardly-depending peripheral side wall 220 terminating in a floor 222 having a plug vent 224, shown as a generally circular aperture therethrough. The reservoir wall 180 is inclined somewhat outwardly. The side wall 220 is similarly inclined somewhat outwardly for snap fit communication with the reservoir wall 180. When the mounting plug 210 is inserted into the reservoir 174, the floor 222 is spaced somewhat above the reservoir floor 182 to form a vented reservoir therebetween, and the living hinge 218 will be received in the hinge trough 172.

The dispensing aperture plug 214 is adapted for frictional communication with the dispensing aperture 176 and comprises a downwardly-depending plug wall 228 terminating in a plug floor 230. A downwardly-inclined inclined portion 226 extends from the strap 212 to the dispensing aperture plug 214. The edges of the strap adjacent to the inclined portion 226 define a pair of spaced-apart strap edges 232.

The plug assembly 164 is mounted to the cap 162 by snap fit insertion of the plug retainer 186 in the reservoir 174, so that the dispensing aperture plug 214 can be frictionally inserted into the dispensing aperture 176. The dispensing aperture plug 214 can be removed from the dispensing aperture 176 by pulling up on the lift tab 216, and the plug assembly 164 can be folded back along the living hinge 218 so that the strap edges 232 are snap fit in the notches 198. The dispensing aperture plug 214 can be reinserted into the dispensing aperture 176 by pulling up on the lift tab 216 to disengage the strap edges 232 from the notches 198 and reinserting the dispensing aperture plug 214 into the dispensing aperture 176.

The novel recloseable lid disclosed herein provides a disposable dome-shaped lid having a drink opening sealable with a closure plug connected by a pivotable strap having an attached mounting plug which engages a mounting receptacle in the lid for removably attaching the closure plug to the lid. The recloseable lid can be thermo-formed, thereby minimizing cost and maximizing product output. The frictional engagement of the closure plug in the drink opening provides a positive liquid-tight closure which seals the container against spillage while readily enabling the container to be opened for dispensing of the liquid. The configuration of the drink opening facilitates a positive seal with the user's mouth, thereby minimizing spillage during drinking. The strap can be folded away from the drink opening and retained in the open position by frictional engagement of the strap with a slot formed in the lid. The mounting plug and mounting receptacle are of different heights to form a reservoir therebetween having vents therethrough for equalizing the pressure on both sides of the lid, which is particularly important since the drink opening configuration will tend to encourage the user to apply a slight suction to the container while drinking.

Figure 10:
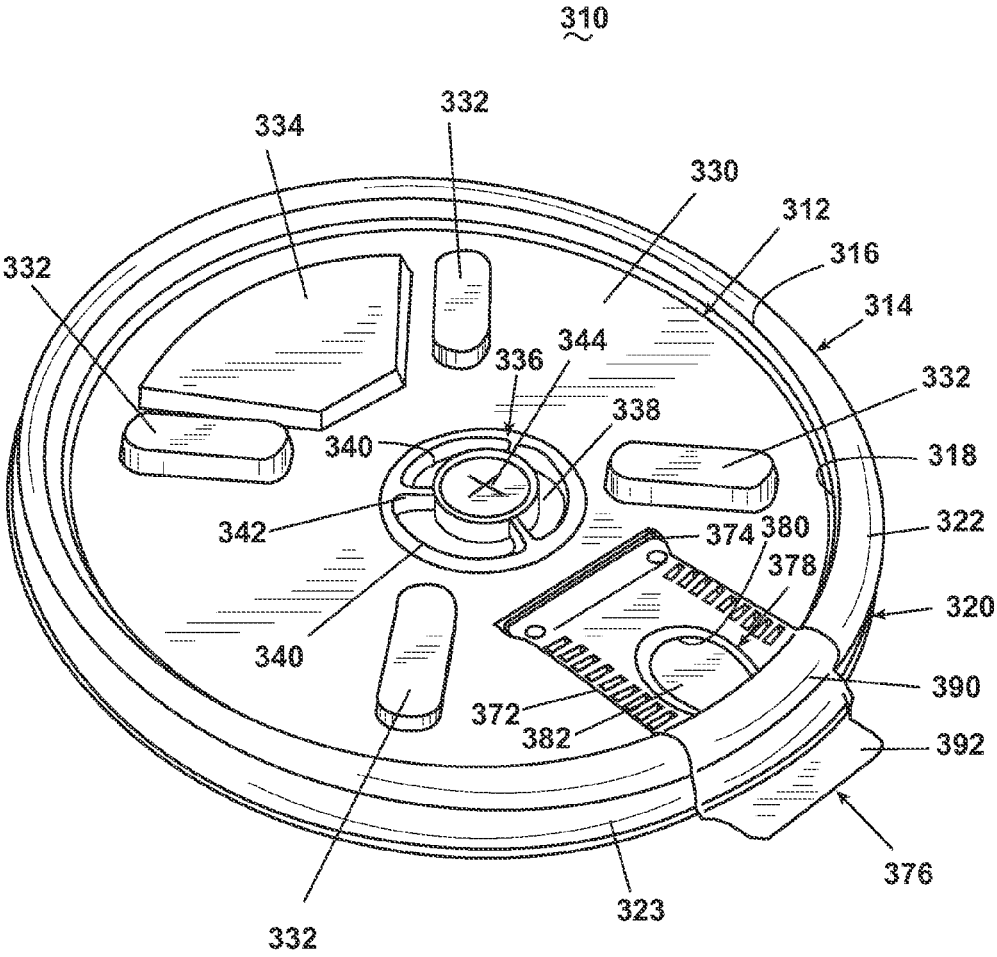
FIG. 10 is a top perspective view of a third embodiment recloseable lid with a tab closure according to the invention shown in the closed position.
Figure 11:
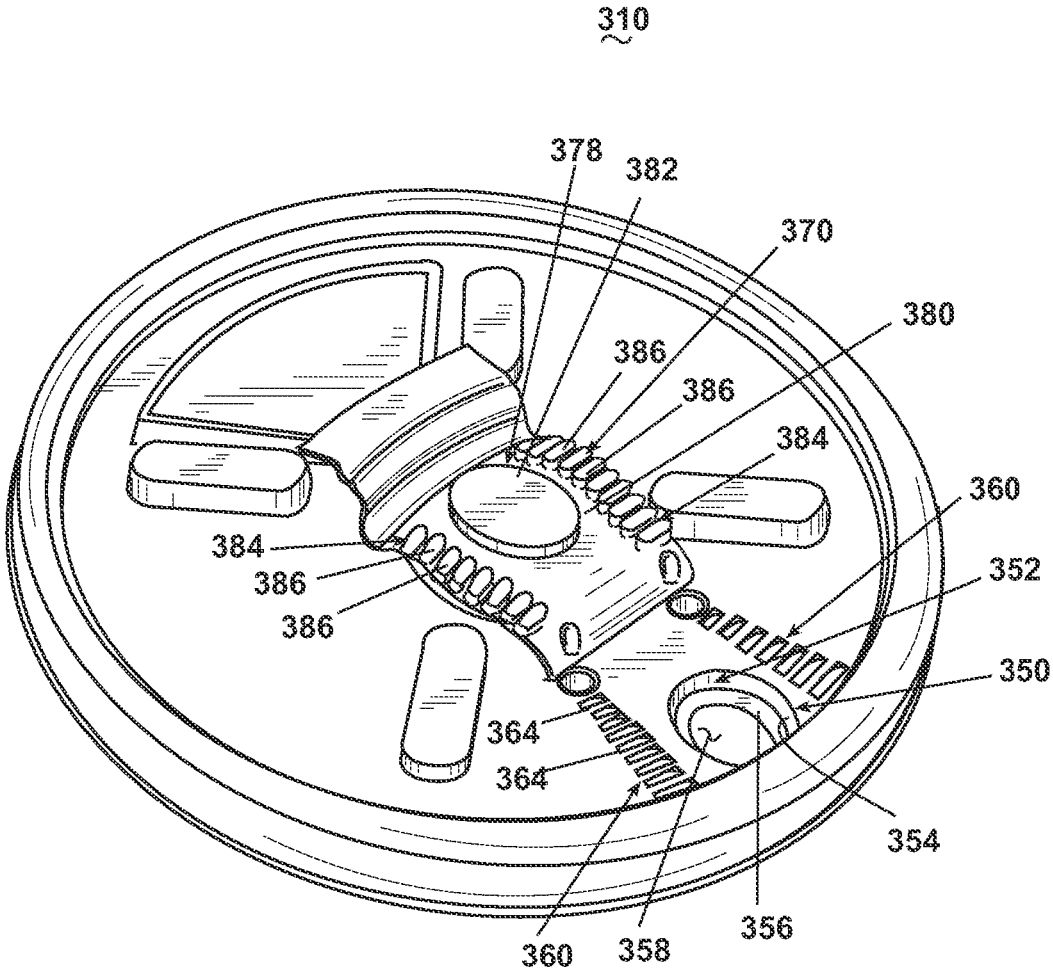
FIG. 11 is a top perspective view of the third embodiment recloseable lid according to the invention shown in the open position.

Referring to FIGS. 10 and 11, the third embodiment recloseable lid 310 comprises a cap 312 connected to a cup mount 314 in such a manner as to define a channel 316 therebetween. The cup mount 314 secures the cap 312 to an upper edge or rim of a cup (not shown) to close the open top of the cup.

The cup mount 314 comprises spaced annular interior and exterior walls 318 and 320, which are connected along their upper edges by an annular top wall 322 to define a bottom-opening interior channel (not shown) disposed between the interior and exterior walls 318, 320. The interior wall 318 is generally vertical although it will typically have a slight taper to aid in removal from a mold during the preferred thermoforming process. The exterior wall 320 has an inwardly extending annular rib 323, which forms a reduced cross-sectional area portion of the interior channel, which typically has a width less than the thickness of the cup upper edge or rim such that when the cup upper edge or rim is pressed into the interior channel, the exterior wall is deflected radially outwardly and the inherent resiliency of the exterior wall applies a compressive force to the upper edge or rim of the cup to mount the recloseable lid to the cup.

The cap 312 comprises a generally planar top wall 330, which lies slightly below the cup mount top wall 322. Multiple, spaced protrusions 332, 334 extend upwardly from the top wall 330 and form part of a stacking feature with their radial periphery. That is, the effective radial periphery defined by the spaced protrusions 332, 334 is typically of such a size that they are received within the bottom of another cup placed on top of the top wall 330.

A vent 336 is formed in a central portion of the top wall 330 and comprises a cylindrical projection forming a chimney 338. The bottom of the chimney 338 is received in a recess 340 formed in the top wall 330. Support ribs 342 are located within the recess and extend radially outwardly from the chimney 338, through the recess 340, where they transition into the top wall 330. An annular recess 343 is formed in the chimney below the top of the chimney. A vent opening 344 is formed in the top of the chimney 338. Variations of the vent 336 are described in U.S. Pat. No. 4,953,743, whose disclosure is incorporated by reference.

A dispensing opening 350 is formed in the top wall 330 near the cup mount 314. The dispensing opening 350 comprises a recess or well 352 comprising a peripheral sidewall 354 that transitions into a planar bottom wall 356. A through opening 358 is formed in the bottom wall 356. Preferably, the dispensing opening 350 has an oval shape. Many other shapes are suitable for the dispensing opening and the shape of the dispensing opening 350 is not limiting to the invention.

A series of radially extending recesses 360 are formed on opposite sides along the dispensing opening 350 and extend radially inwardly from the cup mount 314 toward the centrally located vent 336. Each series 360 comprises multiple recesses 362, each of which are separated by a rib 364. The size of the recesses 362 generally decreases as they extend from the cup mount toward the vent 336. The recesses 362 preferably have a trapezoidal shape, except for the most radially inward recess, which has a circular shape.

The recloseable lid 310 further comprises a plug tab 370 that has a generally planar portion 372 terminating at one end in a hinge 374 and transitioning at an opposing end into a lift tab 376. The hinge 374 can be formed by any suitable means. Preferably, the hinge is formed as part of the mounting of the plug tab 370 to the lid 310. For example, the end of the plug tab 370 can be taped or sonically welded to the top wall 330 which also forms the hinge. The hinge permits the plug tab 370 to be moved into and out of an overlying relationship with the dispensing opening 350 for closing and opening the dispensing opening.

The generally planar portion 372 comprises a plug 378 sized to be received within the dispensing opening 350 to seal the dispensing opening 350 when the plug tab 370 overlies the dispensing opening 350 to place the recloseable lid in the closed position. The plug 378 is preferably a closed recess formed by a peripheral wall 380 that transitions into a bottom wall 382. In the third embodiment, the peripheral wall 380 bears against the peripheral sidewall 354 of the dispensing opening to form a seal between the plug tab 370 and the top wall 330.

The planar portion further comprises a series of spaced projections 384 disposed on opposite sides of the plug 378 and extending away from a lower surface of the planar portion 372. Each series of spaced projections 384 comprises multiple projections 386 that are arranged on the planar portion 372 such that they correspond to and cooperate with the recesses 362 formed in the top wall 330. Preferably, the projections 386 are sized and shaped such that they can be snap-fit within the corresponding recesses 362. The snap-fit receipt of the projections 386 within the corresponding recesses 362 effectively locks the plug tab 370 in the closed position.

The lift tab 376 extends beyond the peripheral area of the cup mount 314 and includes one portion 390 that conforms to the shape of the cup mount 314 and a tab 392 that extends radially away from the cup mount 314 for easy grasp by the user.

In operation, the plug tab 370 can be moved between the closed and opened positions as seen in FIGS. 10 and 11, respectively, by the user. To place the plug tab 370 in the closed position, the user grasps the plug tab 370, preferably by the tab 392, and pivots the plug tab 370 about the hinge 374. The user then presses the plug 378 into the dispensing opening 350 where the peripheral wall 380 of the plug 378 bears against the peripheral wall 352 of the dispensing opening 350 to form a seal therebetween.

Preferably, the peripheral wall 380 is sized and shaped such that it is snugly and compressively received within the dispensing opening 350. The peripheral wall 380 can be formed with a slight draft to enhance the ease of insertion of the plug 378 into the dispensing opening 350 and to improve the seal. Typically, the peripheral wall 380 will form a seal with the dispensing opening 350 at the junction of the top wall 330 with the peripheral wall 352. Therefore, the seal can be further enhanced by providing this junction with a draft or angled surface against which the sidewall 380 will contact.

The user can lock the plug tab 370 in the closed position by pressing the projections 386 into the corresponding recesses 362.

To move the lid 310 into the open position, the user merely lifts on the tab 392 to remove the plug 378 from the recess opening and the projections 386 from the corresponding recesses 362 and rotate the plug tab 370 about the hinge 374. The plug tab 370 can be locked in the opened position as illustrated in FIG. 11 by pressing the plug 378 onto the chimney 338. To remove the plug tab 370 from the opened and locked position, the user pulls on the tab 392.

Figure 12:
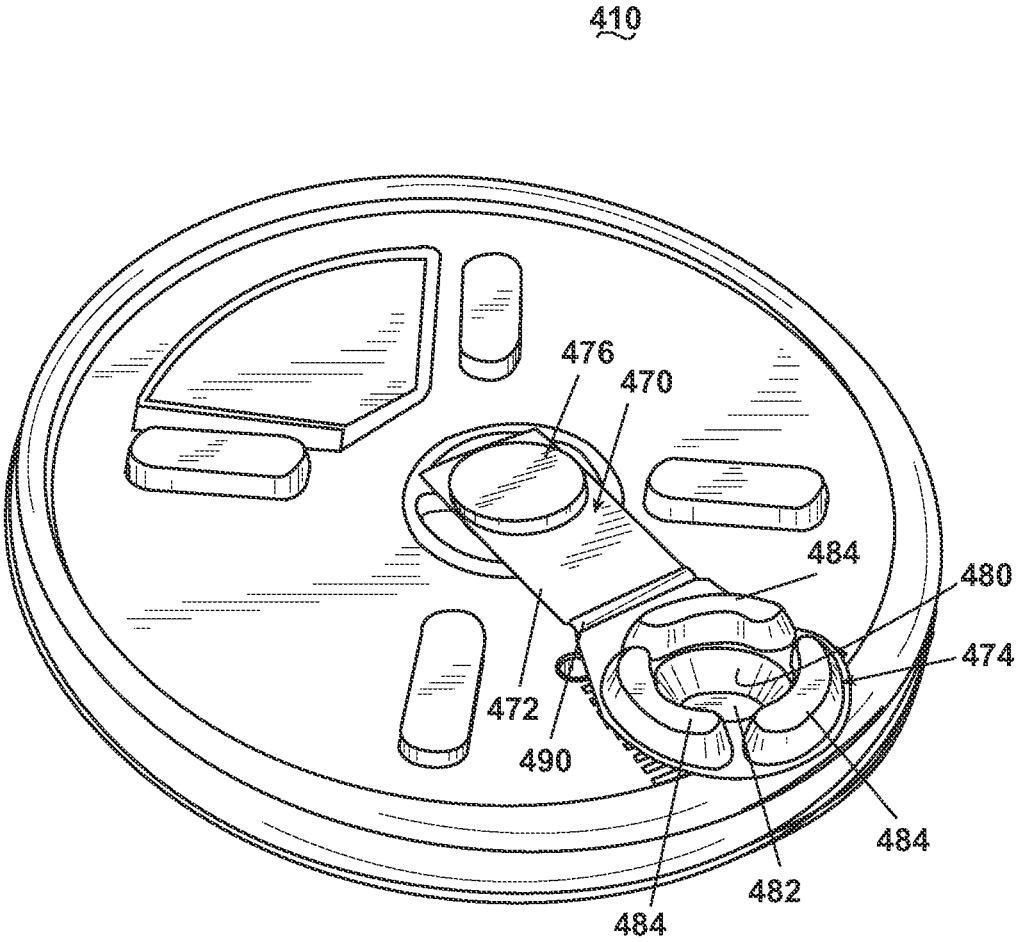
FIG. 12 is a top perspective view of a fourth embodiment recloseable lid according to the invention shown in the closed position.
Figure 13:
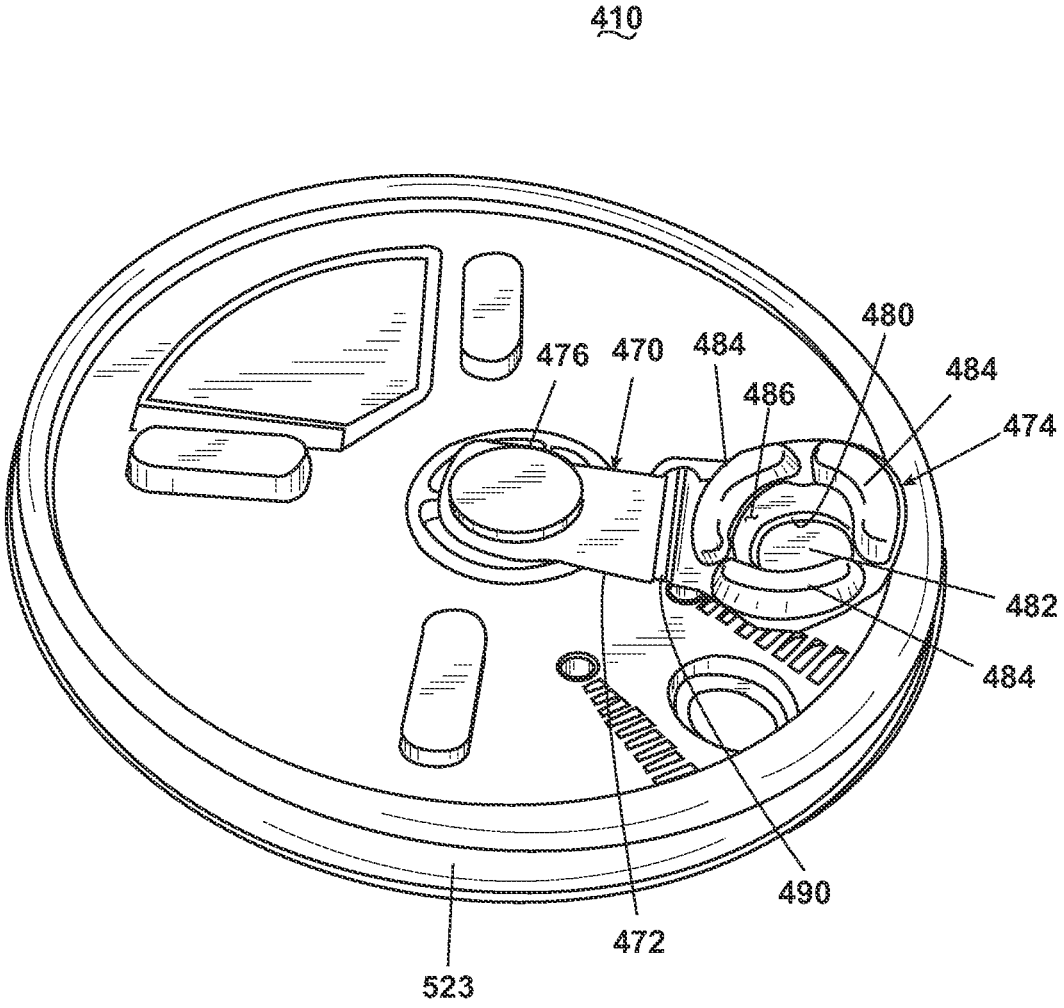
FIG. 13 is a top perspective view of the fourth embodiment recloseable lid according to the invention shown in the open position.

Referring to FIGS. 12 and 13, the fourth embodiment recloseable lid 410 will be described. The fourth embodiment recloseable lid 410 is similar in construction to the third embodiment 310. Namely, the recloseable lid 410 is identical to the closable lid 310 except for the construction of the plug tab and the manner of mounting the plug tab. Therefore, elements in the lid 410 that are similar between the third and fourth embodiment will be identified with like numerals and it will be understood that the description in the third embodiment applies to the second embodiment. Additionally, the description of the fourth embodiment recloseable lid 410 will be limited to the plug tab 470.

The plug tab 470 comprises a planar portion 472 and a plug 474. One end of the planar portion 472 is movably mounted to the top wall 330, preferably by a snap recess 476 formed in the planar portion 472 and which is sized to receive the chimney 338 in a snap-fit relationship to snap-fit the planar portion to the chimney 338 in such a manner to permit the rotation of the planar portion 472 relative to the top wall 330. It is worth noting that the third embodiment can also be made with the snap recess and be snap fit to the chimney 338 instead of using tape or sonic welding.

The plug 474, like the plug 378, also comprises a well-type or recess formed by a peripheral wall 480 that transitions into a planar wall 482. The peripheral wall 480 forms a seal against the dispensing opening peripheral wall 352 in the same manner as described for the third embodiment.

The plug 474 also includes multiple arcuate segments 484 that circumscribe the peripheral wall 480. The arcuate segments 484 define a circular opening 486 and are preferably triangular in cross-section such that the diameter of the circular opening 486 decreases in a direction toward the peripheral wall 480.

A hinge 490 connects the plug 474 to the planar portion 472. The hinge can be thought of as being either a portion of the planar portion 472 or a portion of the plug 474. The hinge 490 permits the plug 474 to be rotated about the hinge 490 such that the snap recess 476 is received within the opening 486 and the continued pressing of the plug 474 onto the snap recess will retain the plug 474 on the snap recess 476.

In operation, the plug 474 is moved between the closed and opened positions as shown in FIGS. 12 and 13 by rotating the plug tab 470 about the axis of the snap recess 476. The plug 474 is pressed into the dispensing opening 350 in the same manner as described for the third embodiment to seal the dispensing opening 350. To remove the plug from the dispensing opening 350, the user need only grasp the sides of the plug and lift upwardly. The plug 474 can be provided with a lift tab to aid in the lifting of the plug if desired.

The plug 474 can also be moved into a stored position by rotating the plug 474 about the hinge 490 and pressing the plug 474 onto the snap recess 476.

The unique structure of the plug tab 470 according to the fourth embodiment enables the plug 474 to be used for not only opening and closing the dispensing opening 350, but also permits the plug 474 to be stored in a position that does not interfere with drinking from the dispensing opening 350.

Figure 14:
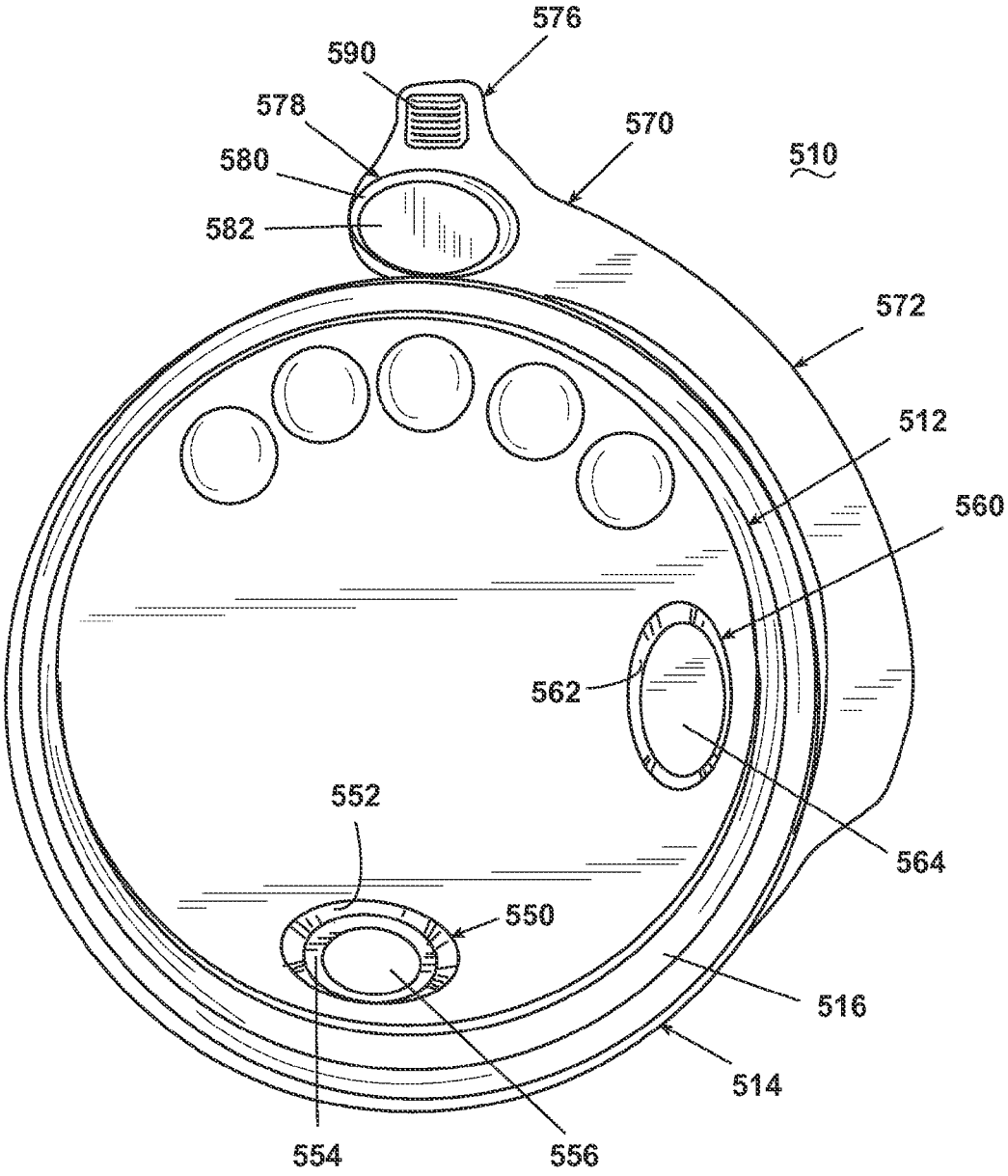
FIG. 14 is a top perspective view of a fourth embodiment recloseable lid according to the invention shown in the open position.
Figure 15:
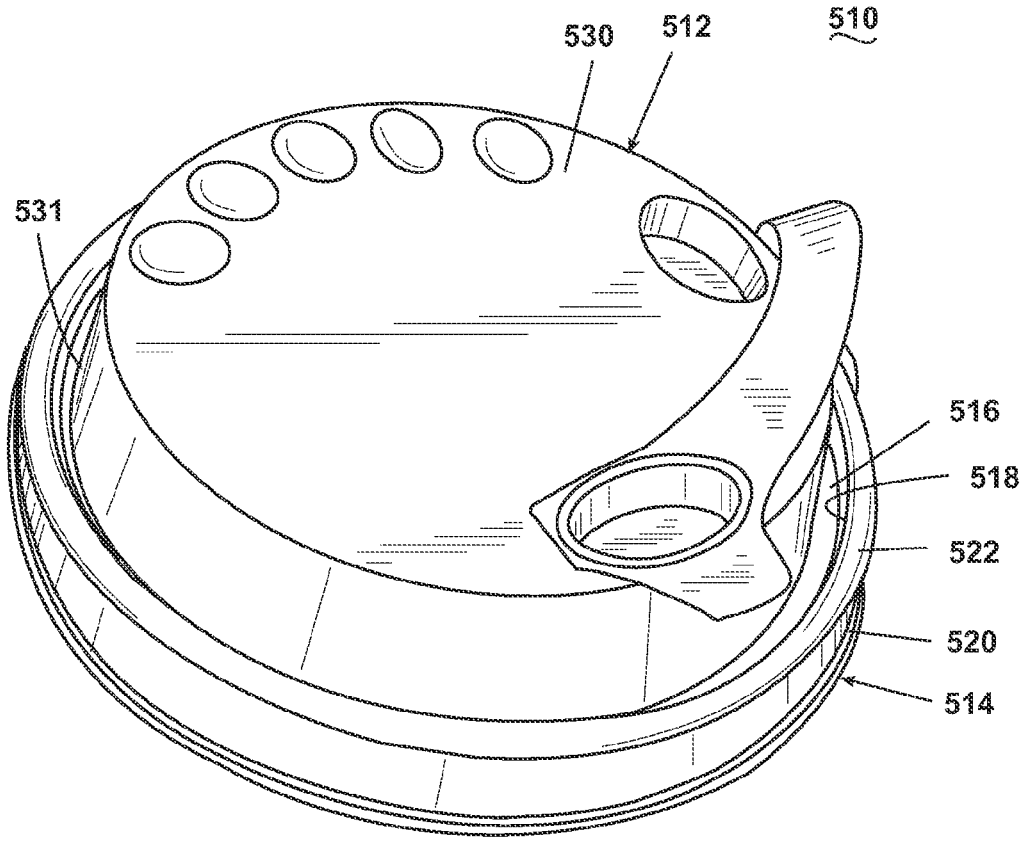
FIG. 15 is a top perspective view of the fifth embodiment recloseable lid according to the invention shown in the closed position.
Figure 16:
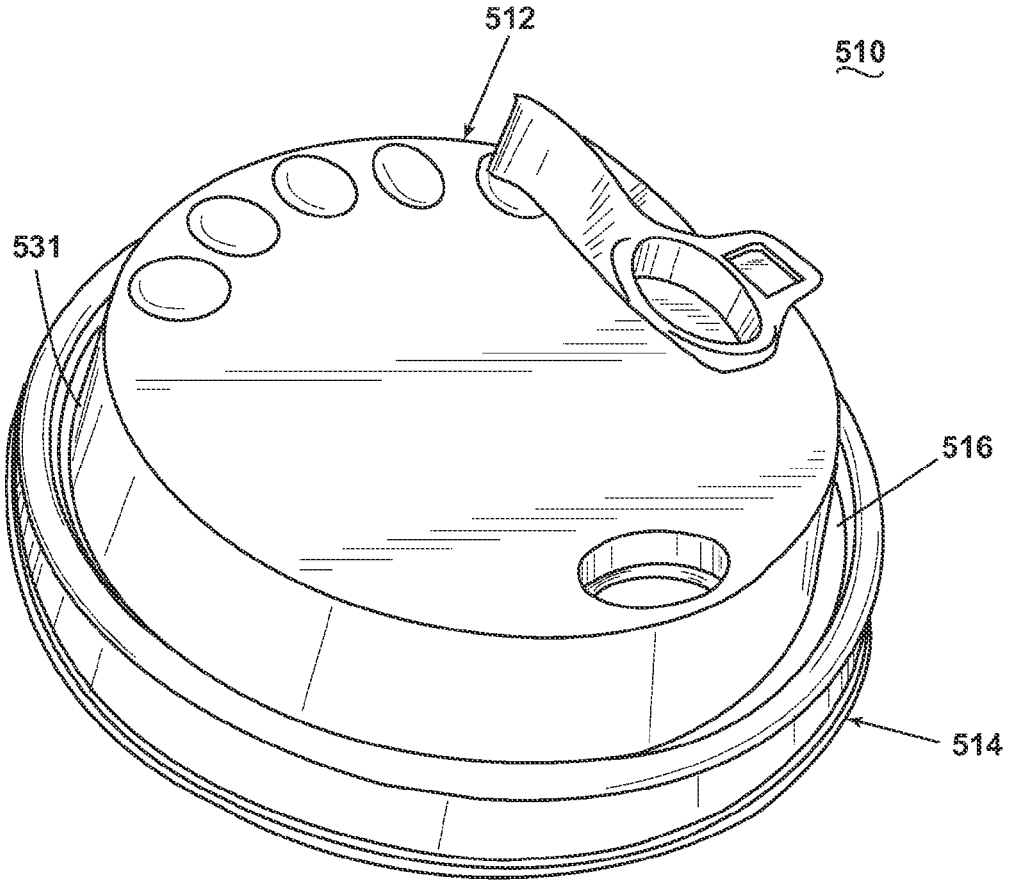
FIG. 16 is a top perspective view of the fifth embodiment recloseable lid according to the invention shown in the stored position.

A fifth embodiment recloseable lid 510 is disclosed in FIGS. 14-16. The fifth embodiment recloseable lid comprises a cap 512 connected to a cup mount 514 in such a manner as to define a channel 516 therebetween.

The cup mount 514 is substantially identical to the cup mount 314 in that it comprises interior and exterior walls 518 and 520, connected by top wall 522, all of which collectively form a bottom-opening interior channel. The outer wall further comprises an inwardly extending annular rib 523.

The cap 512 of the fifth embodiment comprises a top wall 530 that is spaced above the cup mount 514 and connected thereto by an annular wall 531. Therefore, the cap 512 of the fifth embodiment provides substantial interior volume, unlike the first and fourth embodiment. Because of the extra interior volume, the fifth embodiment recloseable lid 510 is highly suited for drinks having a foam or froth, such as cappuccino. A dispensing opening 550 is formed in the top wall 530. The dispensing opening 550 is similar in structure to the prior dispensing opening 350 in that it comprises a peripheral sidewall 552 that transitions into a bottom wall 554 in which is formed an opening 556. Preferably, the peripheral wall 552 has a slight draft and the bottom wall 554 is generally planar.

A storing recess 560 is also formed in the top wall 530. The storing recess 560 comprises a peripheral sidewall 562 that transitions into a bottom wall 564. Like the dispensing opening 550, the peripheral sidewall 562 preferably has a slight draft and the bottom wall 564 is generally planar. It is preferred that the storing recess 560 have substantially the same physical characteristics as the dispensing opening 550, except for the opening 556.

A plug tab 570 extends from the cup mount 514 and comprises a planar portion 572, a lift tab 576, and a plug 578. The planar portion 572 effectively connects the plug 578 in the lift tab to the cup mount 514. It is preferred that the planar portion 572 be sufficient to permit the plug 578 to be moved into an overlying relationship with respect to the dispensing opening 550 so that the plug 578 can be inserted into and close the dispensing opening 550.

In a lid with a circular form as illustrated in FIGS. 14-16, it is preferred that the planar portion 572 connect with the cup mount 514 in a location that is approximately 90 degrees away from the location of the dispensing opening 550. It is also preferred that the planar portion 572 have a length that effectively places the plug 578 in a radial position that is diametrically opposed relative to the dispensing opening 550. Such a configuration provides the user with a sufficient length of planar portion to easily move the plug 578 into an overlying relationship with the dispensing opening 550 and the storing opening 560.

It is important to note that the location and length of the planar portion 572 as illustrated and described is preferred, but is not the only possible location and length. The invention only requires that the location and length of the planar portion 572 be sufficient to permit the plug 578 to be placed in an overlying relationship with respect to the dispensing opening 550.

The plug 578, as with the other plug, is preferably shaped to conform with the dispensing opening 552. Therefore, the plug 578 comprises a peripheral wall 580 that transitions into a bottom wall 582. The peripheral wall 580 preferably has a draft to permit the easy insertion of the plug 578 into the dispensing opening 550 along with permitting the peripheral sidewall 580 to bear against and form a seal with the peripheral sidewall 552. Since the storing opening 560 is preferably the same shape as the dispensing opening 550, the plug 578 can also be received and retained within the storing opening 560 in the same manner.

The lift tab 576 can include a series of projections 590 to aid the user in grasping and holding onto the lift tab 576.

In operation, the user can insert the plug 578 into the dispensing opening 550 to close the recloseable lid 510 as illustrated in FIG. 15. In the closed position, the peripheral sidewall 580 of the plug 578 bears against the peripheral sidewall 552 of the dispensing opening 550 to effect the seal therebetween. When the user desires to take a drink, the user merely lifts the lift tab 576 to remove the plug 578 from the dispensing opening 550. The user has the option of leaving the plug 578 to rest freely in its natural position or store the plug 578 by inserting the plug 578 into the storing opening 560 as illustrated in FIG. 16.

FIGS. 17-23 illustrate alternative tear-away plug tab designs in the context of the fifth embodiment recloseable lid. The main difference between the recloseable lid as illustrated in FIGS. 17-23 and that of the fifth embodiment disclosed in FIGS. 14-16 is that a tear-guide structure connects the plug tab to the cup mount of the recloseable lid until the plug tab is partially separated from the recloseable lid by the consumer or end user. The tear-guide structure is beneficial in that the plug tab is maintained as a part of the recloseable lid up until the time the plug tab is used, which reduces the likelihood that the plug tab will be damaged or completely separated from the recloseable lid before distribution to the consumer.

Since the general structure of the recloseable lid illustrated in FIGS. 17-23 is substantially identical to that structure of the fifth embodiment disclosed in FIGS. 14-16, like parts will be identified by like numerals, with it being understood that the description operation of the like parts in FIGS. 14-16 applies to the similarly numbered parts in FIGS. 17-23.

Figure 17:
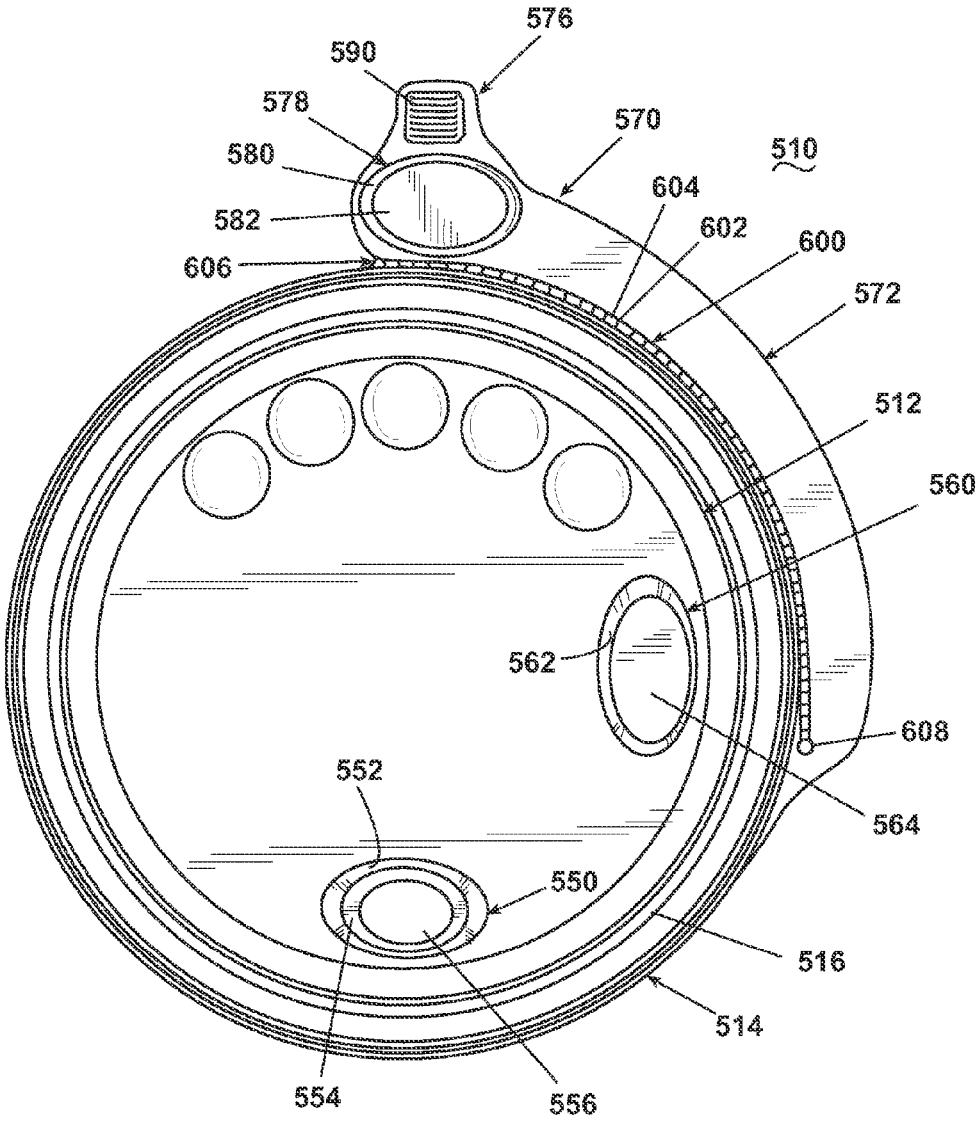
FIG. 17 is a top view of the fifth embodiment recloseable lid and illustrating a first alternative tear-away plug tab design.
Figure 18:
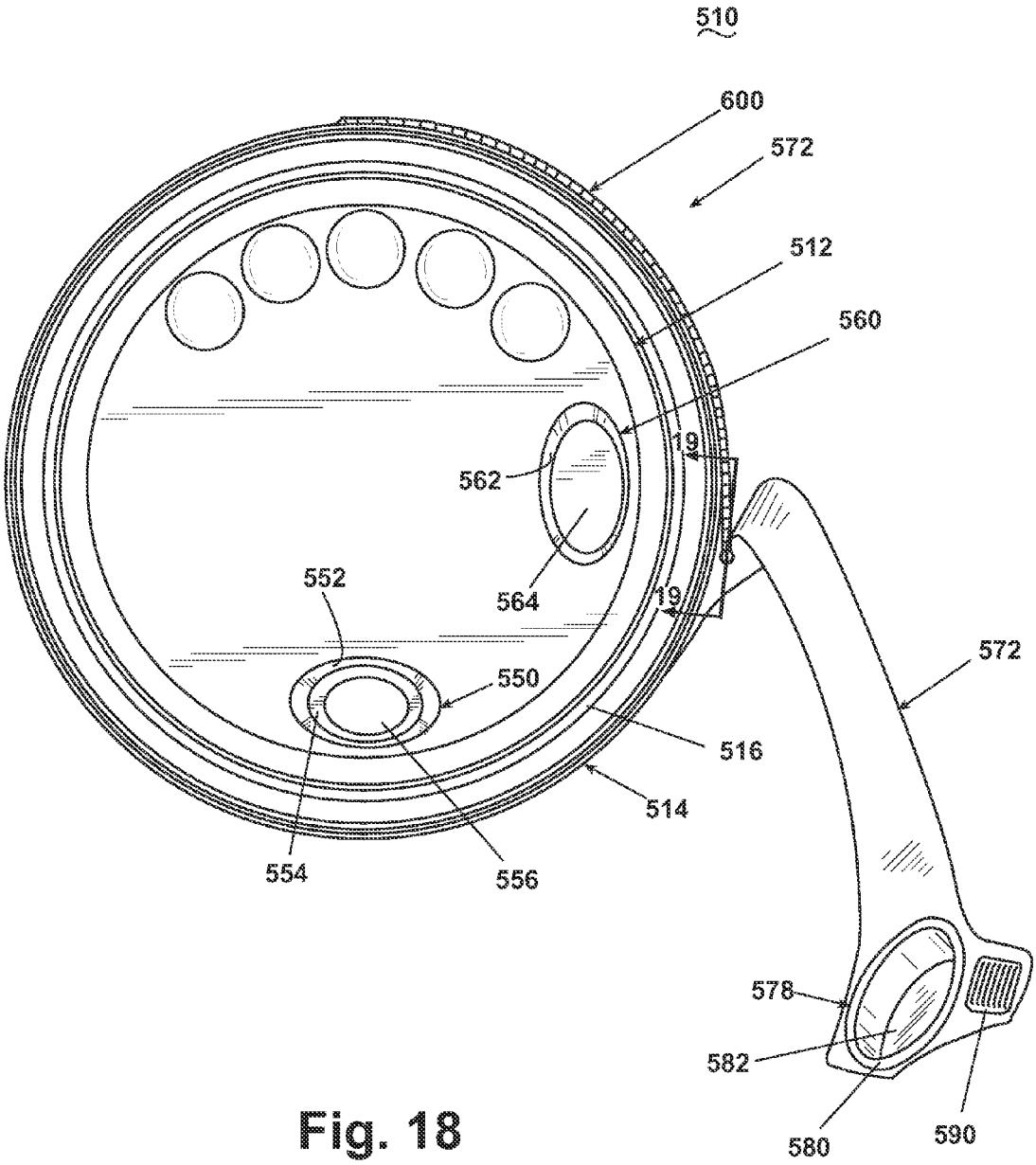
FIG. 18 is a top view similar to FIG. 17 and illustrating the first alternative tear-away plug tab design in a separated condition.
Figure 19:
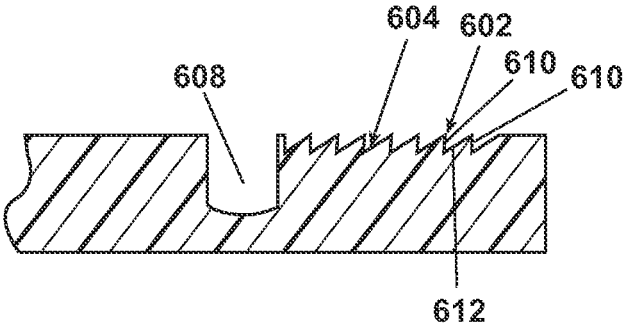
FIG. 19 is a side view of a tear-guide structure as shown along line 10-10 in FIG. 18.

FIGS. 17-19 illustrate the recloseable lid 510 with a tear guide 600, connecting the plug tab 570 to the recloseable lid 510, preferably at the lower edge of the cup mount 514. The tear guide 600 comprises a series of alternating ridges 602 and valleys 604, which began near the junction 606 of the plug portion of the plug tab 570 and the cup mount 514 and terminate in a well 608 located near the end of the planar portion 572 opposite the plug portion. Preferably, the alternating ridges 602 and valleys 604 follow the periphery of the cup mount 514 to form an arcuate path.

As best seen in FIG. 19, the alternating ridges 602 and valleys 604 preferably have a saw-tooth cross-section comprising a generally vertical wall 610 and a corresponding angled wall 612. The angled wall 612 extends between adjacent vertical walls 610. The intersection of the angled wall 612 with the upper end of one of the adjacent vertical walls 610 forms the peak for the ridges 602. The intersection of the angled wall 612 with the lower end of the other of the adjacent vertical walls 610 forms the low point of the valley 604.

The well 608 is preferably a cylindrical depression formed in the planar portion 572 of the plug tab 570 and terminates in a concave shape.

The ridges 602, valleys 604, and well 608 are preferably formed during the thermoforming of the lid using traditional thermoforming techniques. For example, the portion of the mold forming the upper surface of the plug tab 570 will include a structure that is complementary in shape to the ridges 602, valleys 604, and well 608 to thereby form the ridges 602, valleys 604, and well 608 when the mold is brought into contact with the material used to form the recloseable lid 510.

The junction 606 is preferably shaped such that it induces the initiation of a tear in the plug tab 570 in a direction toward the tear guide 600 when the user began separating the plug tab 570 from the cup mount 514, preferably by grasping the plug 578 and/or lift tab 576 and pulling the plug tab away from the cup mount 514. The shaping of the junction 606 can include making the junction 606 terminate in a relatively sharp point such that any tear will began at the point. The point is located adjacent the tear guide to ensure the tear reaches the guide. Additionally, a small slit can also be formed in the junction 606. It is also possible that the ridges 602 and valleys 604 extend entirely up to the junction 606.

Once the tear in the plug tab 570 reaches the tear guide 600, the plug tab 570 will naturally separate along the tear guide 600 in response to the continued pulling by the user. The tear guide, as best seen in FIG. 19, generally has an overall thickness that is less than the rest of the plug tab 570. The reduced thickness aids in controlling the direction of the tear and limiting the tear to a path as defined by the tear guide 600. Additionally, the shape of the ridges 602 and valleys 604 are such that the material will naturally tear in a direction that is orthogonal to the general orientation of the ridges 602 and valleys 604, which further aids in the separation following the tear guide 600.

The well 608 resists the continued tearing along the tear guide 600 defined by the ridges 602 and valleys 604 because the inner surface of the well is sharply angled (orthogonal as illustrated) relative to the plane of the tear guide. The sharp change in the surface along the path of the tear causes the force created by the user pulling up on the plug tab to change from an orthogonal shearing force to a coplanar tensile force as the tear moves from the plug tab upper surface to the inner surface of the well 608. The coplanar tensile force is much less likely to continue the tearing of the material as well as providing the user with a tactile "stop" as the tear reaches the well.

FIG. 18 illustrates the plug tab 570 after it has been separated or torn away from the cup mount 514. Once the plug tab 570 is torn from the cup mount 514, the plug 578 can be used to seal the dispensing opening 550 or be stored in the stored opening 560 as previously described.

Figure 20:
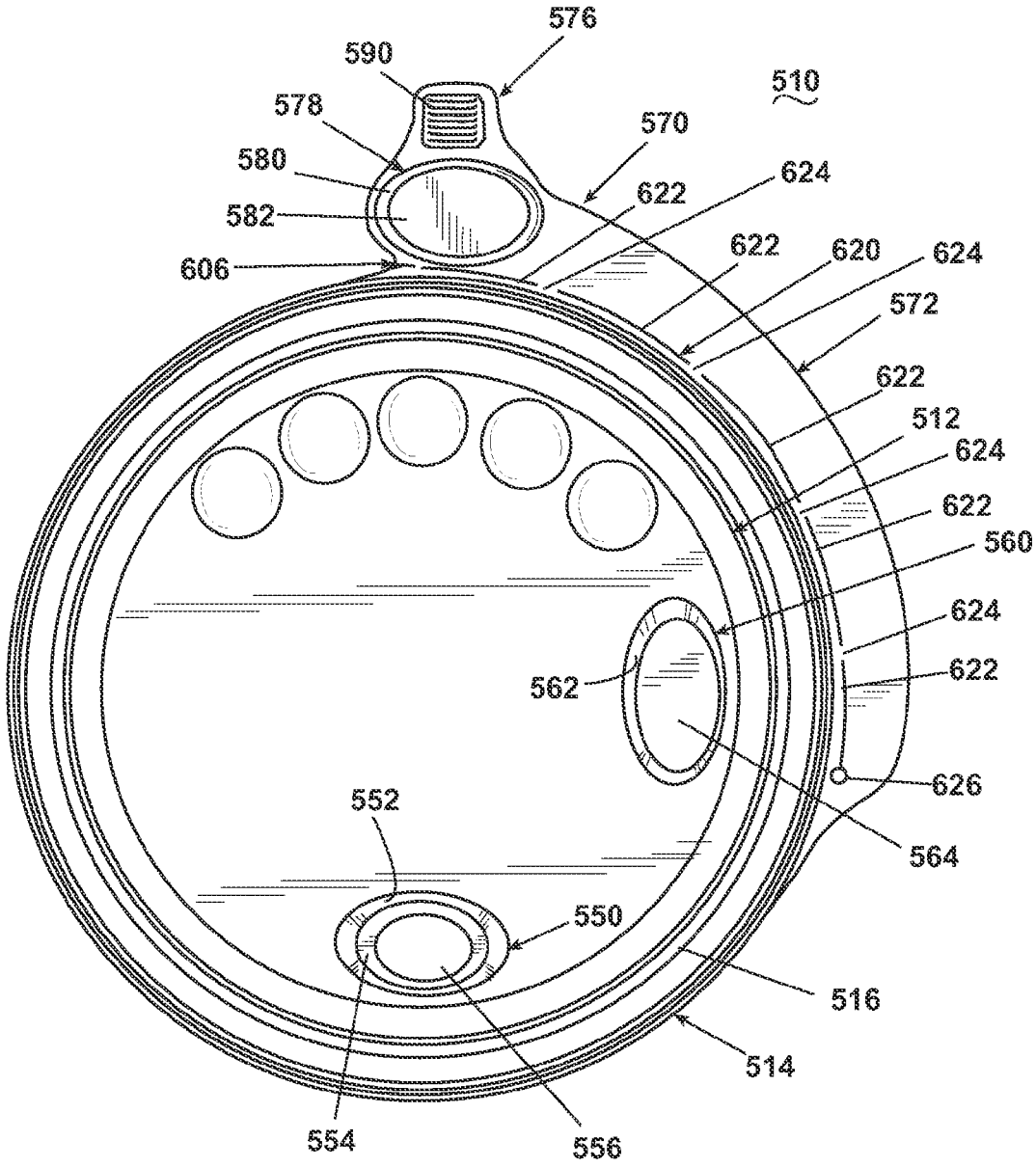
FIG. 20 is a top view of the fifth embodiment recloseable lid and illustrating a second alternative tear-away plug tab design.

A second alternative tear guide 620 is illustrated in FIG. 20. The tear guide 620 comprises a series of alternating valleys 622 and ridges 624. The valleys 622 are preferably slits formed in the plug tab 570. The portions of the plug tab 570 interposed between the adjacent slits form the ridges 624. These interposed portions are often referred to as "ticks". While the slits preferably extend entirely through the plug tab 570, a reduced thickness portion can be used in place of the slits. The slits tend to better control the direction of the tear since the material is already completely separated along the slit.

The number of slits and ticks can vary as required. While multiple corresponding pairs of slits and ticks are illustrated, it is within the scope of the invention for there to be a single slit and a single tick. In such a configuration, it is preferred that the tick be located near the junction 606 and the slit extend away from the tick toward the end of the plug tab 570 opposite the plug 578.

An opening 626 is preferably located at the end of the last slit to inhibit the tearing of the material and thereby prevent the complete separation of the plug tab 570 from the cup mount 514. Alternatively, a well, similar to the well 608, could be used in place of the opening 626.

The slits and opening are formed in the plug tab 570 by one of many well known methods. For example, the mold used during the thermoforming process can include suitable structures to form the slits in the opening. Alternatively, the slits and the opening can be formed in the recloseable lid 510 after the thermoforming process is completed. Since multiple lids are typically thermoformed from a large sheet and must be cut from the sheet, the forming of the slits in the opening can be accomplished prior to or as part of the cutting of the lids from the sheet.

Figure 21:
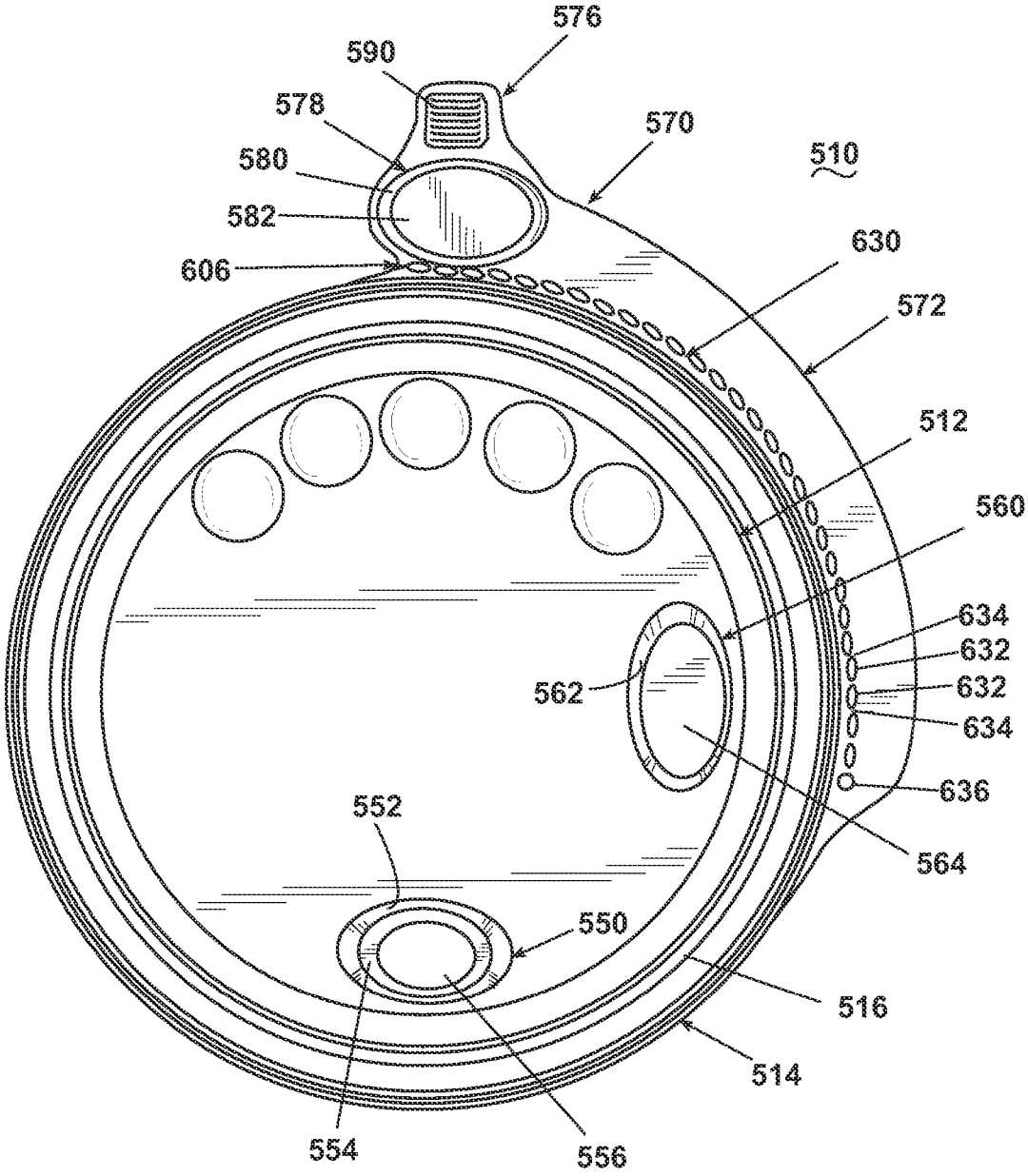
FIG. 21 is a top view of the fifth embodiment recloseable lid and illustrating a third alternative tear-away plug tab design.

FIG. 21 illustrates a third alternative tear guide 630 comprising a series of alternating valleys 632 and ridges 634. The valleys preferably comprise multiple, spaced holes formed in the plug tab 570. The material of the plug tab 570 between the spaced holes form the ridges. In essence, the third alternative tear guide 630 comprises a series of ticks and holes. The holes are illustrated as having an oval shape. However, any desired shape can be used.

Figure 23:
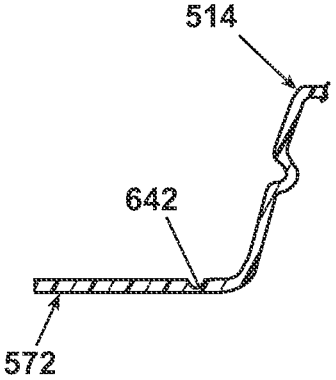
FIG. 23 is a sectional view taken along line 14-14 of FIG. 22.
Figure 22:
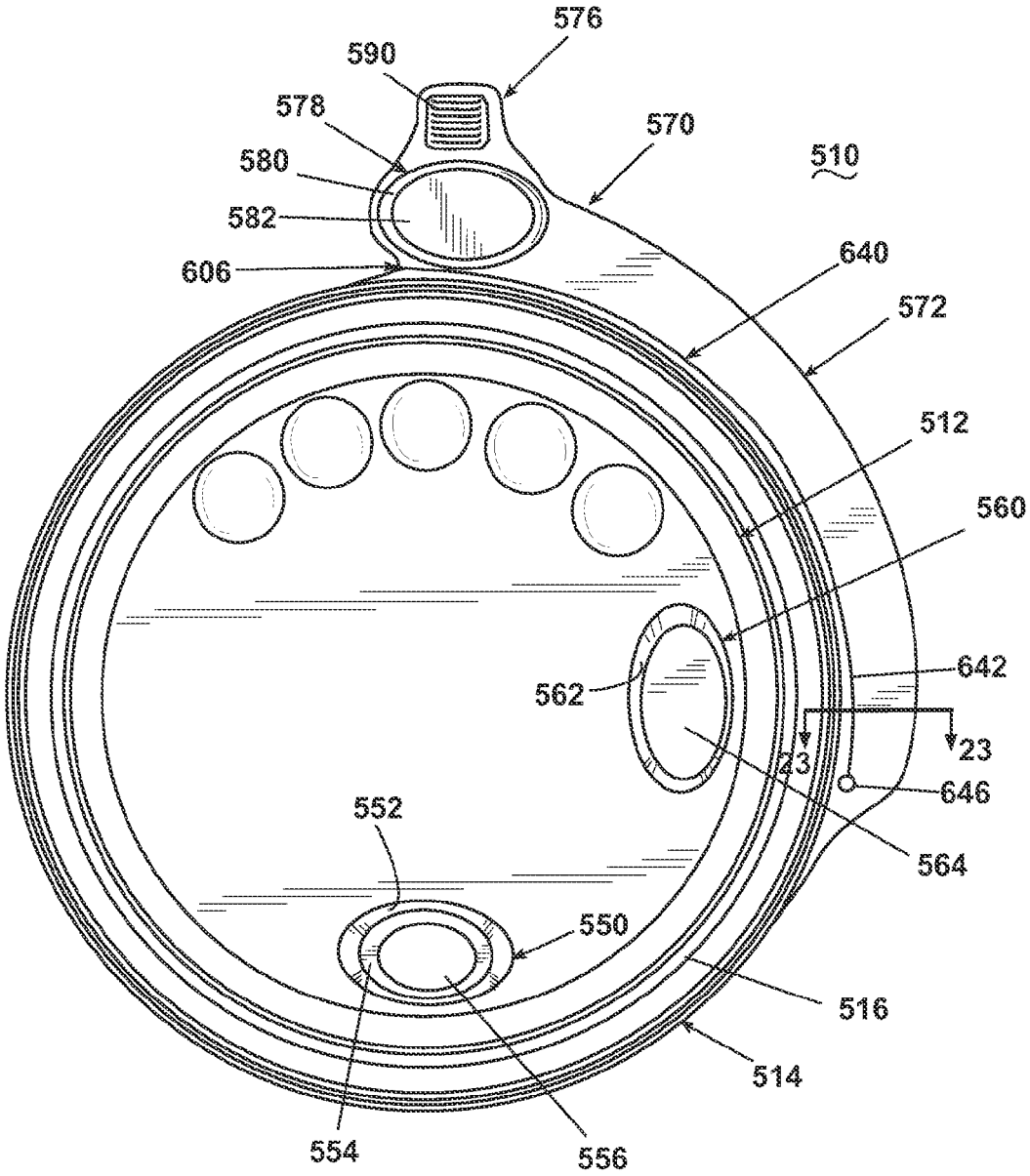
FIG. 22 is a top view of the fifth embodiment recloseable lid and illustrating a third alternative tear-away plug tab design.

FIGS. 22 and 23 illustrate a fourth alternative tear guide 640 comprising a reduced thickness portion located in the plug tab 570 that effectively forms a channel 642. The channel 642 follows an arcuate path that substantially conforms to the periphery of the cup mount 514. The channel 642 preferably begins at the junction 606 and terminates at a well 608. The well 608 can also be replaced by an opening 626.

Figure 24:
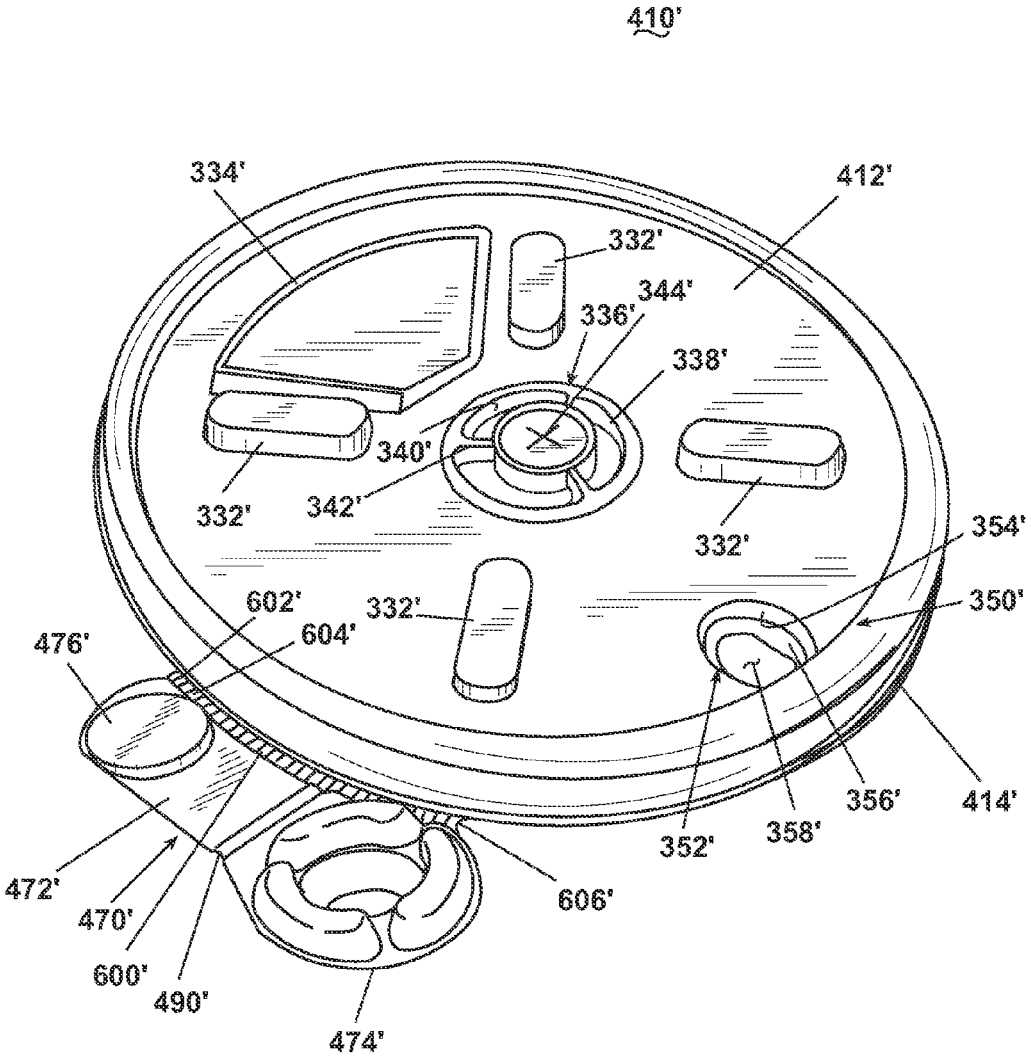
FIG. 24 is a top perspective view of a sixth embodiment recloseable lid incorporating the snap-on plug tab of the third and fourth embodiments with a tear-away plug tab of the fifth embodiment illustrated in FIGS. 17-19.

FIG. 24 illustrates a sixth embodiment lid that comprises a removable, snap-on plug tab by combining the features of the third embodiment shown in FIGS. 12 and 13 with the tear guide shown in FIGS. 17-19. Since the sixth embodiment contains similar elements to those previously described in the respective embodiments, similar elements will be identified with like numerals along with a prime ' superscript, with it being understood that the previous description applies generally to the corresponding element.

The snap-on plug tab 470' is integrally formed with the lid 410' for subsequent removal and snap-on mounting by the user. The plug tab 470' comprises generally planar portion 472', plug 474', snap 476' and hinge 490'.

The snap-on formed plug tab 470' is integrally formed with the lid 410' and includes a tear guide 600'. The tear guide 600' differs from the tear guide 600 in that there is no structure to stop the tear since it is desired to completely remove the snap-on plug tab 470' from the lid and use it in the same manner as the snap-on plug tab 470. Thus, the ridges 602' and valleys 604' preferably extend entirely across the material connecting the plug tab 470' to the lid and there is no well at the end of the ridges 602' and valleys 604'.

Although the tear guide 600' is illustrated, any tear guides shown in FIGS. 17-23 can be used. Also, the plug 370 could be secured to the lid 310 with a tear guide.

The benefit of integrally forming the snap-on plug tab 570' with the lid 310' is that there is no need to assemble the plug-tab to the lid prior to shipping the lid to the customer. This saves assembly cost and will provide for better stacking of the lids.

While the invention has been specifically described in connection with certain specific embodiments thereof, it is to be understood that this is by way of illustration and not of limitation. Reasonable variation and modification are possible within the scope of the forgoing description and drawings without departing from the spirit of the invention. For example, the plug 578 of the third embodiment as shown is connected to the lid by a planar portion 572 that connects only one side of the plug 578 to the lid. It is within the scope of the invention for there to be a second planar portion connecting the opposite side of the plug 578 to the opposite side of the lid. This configuration would provide a planar portion that spans approximately half-way around the lid and forming a pail-handle like structure.

What is claimed is:

1. A thermoformed disposable, recloseable lid for closing an open top of a cup terminating in an annular upper edge, the lid comprising:

a cup mount defining an annular channel for receiving an annular upper edge of a cup for mounting the lid to the cup;

a cap comprising:

an upper surface located above the cup mount;

a peripheral wall with a positive draft angle extending upwardly from the cup mount and terminating at the upper surface; and a mounting recess formed in the upper surface and at least partially defined by a peripheral wall extending downwardly from the upper surface at a negative draft angle to form an undercut relative to the upper surface and an opening for the mounting recess;

a thin-walled hollow structure extending above the upper surface and terminating in a top wall located above the upper surface and a drink opening located in the top wall; and a tab closure comprising a mounting plug and a drink plug connected by a strap, the mounting plug is at least partially defined by a peripheral wall having a negative draft angle such that when the mounting plug is received within the mounting recess to mount the tab closure to the cap, the peripheral wall of the mounting plug lies within the undercut, and the drink plug is received within the drink opening to close the drink opening, and the strap is configured to permit the insertion of the drink plug into the drink opening when the mounting plug is received within the mounting recess, whereby a user can open and close the lid by removing or inserting the drink plug from the drink opening while the tab closure remains mounted to the cap;

wherein the cap, cup mount, and tab closure all have a common thickness and are fabricated of a flexible, thin-walled plastic by a conventional thermoforming process.

2. The thermoformed disposable, recloseable lid according to claim 1 wherein the drink plug has a portion with a dimension greater than or equal to the drink opening such that the drink plug snap-fits within the drink opening.

3. The thermoformed disposable, recloseable lid according to claim 1 wherein the drink opening comprises a well and the drink plug is received within the well when the lid is closed.

4. The thermoformed disposable, recloseable lid according to claim 3 wherein the well and the drink plug are sized such that the drink plug is press-fit within the well.

5. The thermoformed disposable, recloseable lid according to claim 1 and further comprising a drink plug holder for holding the drink plug in a stored position when the lid is in the open position.

6. The thermoformed disposable, recloseable lid according to claim 5 wherein the drink plug holder comprises:

an inwardly extending boss extending from one of the cap and cup mount and overlying a portion of the tab closure to hold the drink plug in a stored position;

a recess in the cap and which is sized to receive the drink plug and hold the drink plug in a stored position; or a mounting plug on one of the cap and tab closure and a complementary recess on the other of the cap and tab closure such that the mounting plug is received within the recess and holds the drink plug in a stored position.

7. The thermoformed disposable, recloseable lid according to claim 1 wherein the tab closure further comprises a hinge on the strap enabling the drink plug to pivot relative to the mounting plug.

8. The thermoformed disposable, recloseable lid according to claim 7 wherein the drink plug includes a lift tab for aid in the removal of the drink plug from the drink opening by rotating the drink plug about the hinge.

9. The thermoformed disposable, recloseable lid according to claim 1 wherein the mounting recess has a bottom wall and the mounting plug has a bottom wall, which is spaced above the mounting recess bottom wall when the mounting plug is received within the mounting recess to define a chamber therebetween.

10. The thermoformed disposable, recloseable lid according to claim 9 and further comprising a vent opening formed in the mounting recess bottom wall and fluidly connected to the chamber, and the mounting plug has a vent opening fluidly connected to the chamber, wherein the mounting plug vent opening is sized such that liquid cannot span the vent opening through the inherent surface tension of the liquid.

11. The thermoformed disposable, recloseable lid according to claim 1 wherein the thin-walled hollow structure has a reduced width at opposite ends of the drink opening.

12. The thermoformed disposable, recloseable lid according to claim 1 wherein the cap and closure tab are thermoformed from a common sheet of plastic.

13. The thermoformed disposable, recloseable lid according to claim 1 wherein the annular channel is a peripheral channel sized to receive a rim of a cup.

14. A thermoformed disposable, recloseable lid for closing an open top of a cup terminating in an annular upper edge, the lid comprising:

a cup mount having an inner annular wall, an annular skirt spaced from the inner annular wall, and a top wall connecting the inner annular wall and annular skirt, with an annular channel for receiving an annular upper edge of a cup for mounting the lid to the cup defined by the inner annular wall, annular skirt, and top wall;

a cap comprising:

an upper surface located above the cup mount;

a peripheral wall with a positive draft angle extending upwardly from the cup mount to the upper surface to define a truncated-cone structure, at least a portion of which is above the cup mount; and a mounting recess formed in the upper surface and having a floor located below the upper surface and a peripheral wall connecting the floor to the upper surface, with the intersection of the peripheral wall and recess defining an opening to the recess in the upper surface;

a thin-walled hollow structure extending above the upper surface of the truncated cone structure and terminating in a top wall located above the upper surface and a drink opening located in the top wall; and a tab closure comprising a mounting plug and a drink plug connected by a strap, wherein:

the mounting plug has a bottom wall located below the strap and a peripheral wall extending upwardly from the bottom wall toward the strap, with at least a portion of the peripheral wall connected to the strap, with the bottom wall and peripheral wall defining a projection that is received within the mounting recess to mount the tab closure to the cap;

and the drink plug has a floor located below the strap and a peripheral wall extending upwardly from the bottom wall toward the strap, with at least a portion of the peripheral wall connected to the strap, with the floor and peripheral wall defining a projection that is received within the drink opening to close the drink opening;

wherein the strap is configured to permit the selective insertion and removal of the drink plug into the drink opening when the mounting plug is received within the mounting recess, whereby a user can open and close the lid by removing or inserting the drink plug from the drink opening while the tab closure remains mounted to the cap;

wherein the cup mount, cap, thin-walled hollow structure, and tab closure all have a common thickness and are fabricated of a flexible, thin-walled plastic by a conventional thermoforming process.

15. The thermoformed disposable, recloseable lid according to claim 14 wherein the tab closure is removably coupled to the cap.

16. The thermoformed disposable, recloseable lid according to claim 14 wherein the mounting plug is sized to be received within the mounting recess to mechanically couple the tab closure to the cap.

17. The thermoformed disposable, recloseable lid according to claim 16 wherein the mounting plug is received within the mounting recess in a press-fit relationship.

18. The thermoformed disposable, recloseable lid according to claim 16 wherein the tab closure comprises a drink plug that is received within the drink opening to selectively close the drink opening.

19. The thermoformed disposable, recloseable lid according to claim 18 wherein the drink plug has a portion with a dimension greater than or equal to the drink opening such that the drink plug snap-fits within the drink opening.

20. The thermoformed disposable, recloseable lid according to claim 18 wherein the mounting plug is located on the tab closure and the mounting recess is located in the upper surface.

21. The thermoformed disposable, recloseable lid according to claim 20 wherein the tab closure further comprises a strap that connects the drink plug to the mounting plug.

22. The thermoformed disposable, recloseable lid according to claim 21 wherein the tab closure further comprises a hinge on the strap enabling the drink plug to pivot relative to the mounting plug.

23. The thermoformed disposable, recloseable lid according to claim 22 wherein the drink plug includes a lift tab for aid in the removal of the drink plug from the drink opening by rotating the drink plug about the hinge.

24. The thermoformed disposable, recloseable lid according to claim 20 wherein the bottom wall of the mounting plug is spaced above the floor of the mounting recess when the mounting plug is received within the mounting recess to define a chamber therebetween.

25. The thermoformed disposable, recloseable lid according to claim 24 and further comprising a vent opening formed in the mounting recess bottom wall and fluidly connected to the chamber, and the mounting plug has a vent opening fluidly connected to the chamber, wherein the mounting plug vent opening is sized such that liquid cannot span the vent opening through the inherent surface tension of the liquid.

26. The thermoformed disposable, recloseable lid according to claim 14 wherein the thin-walled hollow structure has a reduced width at adjacent ends of the drink opening.

27. The thermoformed disposable, recloseable lid according to claim 14 and further comprising a drink plug holder for holding the drink plug in a stored position when the lid is in the open position.

28. The thermoformed disposable, recloseable lid according to claim 27 wherein the drink plug holder comprises:

an inwardly extending boss extending from one of the cap and cup mount and overlying a portion of the tab closure to hold the drink plug in a stored position;

a recess in the cap and which is sized to receive the drink plug and hold the drink plug in a stored position; or a mounting plug on one of the cap and tab closure and a complementary recess on the other of the cap and tab closure such that the mounting plug is received within the recess and holds the drink plug in a stored position.

29. The thermoformed disposable, recloseable lid according to claim 14 wherein the cap and closure tab are thermoformed from a common sheet of plastic.

30. The thermoformed disposable, recloseable lid according to claim 14 wherein the annular channel is a peripheral channel sized to receive a rim of a cup.

31. The thermoformed disposable, recloseable lid according to claim 14 wherein the peripheral wall of the mounting plug recess has a negative draft angle to form an undercut relative to the upper surface and the peripheral wall of the mounting plug has a negative draft angle such that when the mounting plug is received within the mounting recess to mount the tab closure to the cap, the peripheral wall of the mounting plug lies within the undercut.

32. A thermoformed disposable, recloseable lid comprising:

a cup mount defining an annular channel for receiving an annular upper edge of a cup for mounting the lid to the cup;

a dome-shaped cap in the form of a truncated cone having an upper surface located above the cup mount and a peripheral wall with a positive draft angle connecting the upper surface with the cup mount, and sized to overlie and substantially cover the open top of the cup, with a mounting recess formed in the upper surface;

a thin-walled hollow structure at least partially encircling the upper surface and terminating in a top wall located above the upper surface, with a drink opening located in the top wall; and a tab closure comprising a mounting plug and a drink plug connected by a strap, wherein:

the mounting plug has a bottom wall located below the strap and a peripheral wall extending upwardly from the bottom wall toward the strap, with at least a portion of the peripheral wall connected to the strap, with the bottom wall and peripheral wall defining a projection that is received within the mounting recess to mount the tab closure to the cap;

and the drink plug has a floor located below the strap and a peripheral wall extending upwardly from the bottom wall toward the strap, with at least a portion of the peripheral wall connected to the strap, with the floor and peripheral wall defining a projection that is received within the drink opening to close the drink opening;

wherein the strap is configured to permit the selective insertion and removal of the drink plug into the drink opening when the mounting plug is received within the mounting recess, whereby a user can open and close the lid by removing or inserting the drink plug from the drink opening while the tab closure remains mounted to the cap;

wherein the cup mount, dome-shaped cap, thin-walled hollow structure, and tab closure all have a common thickness and are fabricated of a flexible, thin-walled plastic by a conventional thermoforming process.

33. The thermoformed disposable, recloseable lid according to claim 32 wherein the drink plug has a portion with a dimension greater than or equal to the drink opening such that the drink plug snap-fits within the drink opening.

34. The thermoformed disposable, recloseable lid according to claim 32 wherein the drink opening comprises a well and the drink plug is received within the well when the lid is closed.

35. The thermoformed disposable, recloseable lid according to claim 34 wherein the well and the drink plug are sized such that the drink plug is press-fit within the well.

36. The thermoformed disposable, recloseable lid according to claim 32 and further comprising a drink plug holder for holding the drink plug in a stored position when the lid is in the open position.

37. The thermoformed disposable, recloseable lid according to claim 36 wherein the drink plug holder comprises:

an inwardly extending boss extending from one of the cap and cup mount and overlying a portion of the tab closure to hold the drink plug in a stored position;

a recess in the cap and which is sized to receive the drink plug and hold the drink plug in a stored position; or a mounting plug on one of the cap and tab closure and a complementary recess on the other of the cap and tab closure such that the mounting plug is received within the recess and holds the drink plug in a stored position.

38. The thermoformed disposable, recloseable lid according to claim 32 wherein the tab closure further comprises a hinge on the strap enabling the drink plug to pivot relative to the mounting plug.

39. The thermoformed disposable, recloseable lid according to claim 32 wherein the drink plug includes a lift tab for aid in the removal of the drink plug from the drink opening by rotating the drink plug about the hinge.

40. The thermoformed disposable, recloseable lid according to claim 32 wherein the mounting recess has a bottom wall and the bottom wall, of the mounting plug is spaced above the mounting recess bottom wall when the mounting plug is received within the mounting recess to define a chamber therebetween.

41. The thermoformed disposable, recloseable lid according to claim 40 and further comprising a vent opening formed in the mounting recess bottom wall and fluidly connected to the chamber, and the mounting plug has a vent opening fluidly connected to the chamber, wherein the mounting plug vent opening is sized such that liquid cannot span the vent opening through the inherent surface tension of the liquid.

42. The thermoformed disposable, recloseable lid according to claim 32 wherein the side wall has a reduced width at opposite ends of the drink opening.

43. The thermoformed disposable, recloseable lid according to claim 32 wherein the cap and closure tab are thermoformed from a common sheet of plastic.

44. The thermoformed disposable, recloseable lid according to claim 32 wherein the annular channel is a peripheral channel sized to receive a rim of a cup.

45. A thermoformed disposable, recloseable lid for closing an open top of a cup terminating in an annular upper edge, the lid comprising:

a cup mount defining an annular channel for receiving an annular upper edge of a cup for mounting the lid to the cup;

a cap comprising:

an upper surface located above the cup mount;

a peripheral wall extending upwardly from the cup mount and terminating at the upper surface; and a mounting recess formed in the upper surface and at least partially defined by a peripheral wall extending downwardly from the upper surface at a negative draft angle to form an undercut relative to the upper surface and an opening for the mounting recess;

a thin-walled hollow structure extending above the upper surface and terminating in a top wall located above the upper surface and a drink opening located in the top wall; and a tab closure comprising a mounting plug and a drink plug connected by a strap, the mounting plug is at least partially defined by a peripheral wall having a negative draft angle such that when the mounting plug is received within the mounting recess to mount the tab closure to the cap, the peripheral wall of the mounting plug lies within the undercut, and the drink plug is received within the drink opening to close the drink opening, and the strap is configured to permit the insertion of the drink plug into the drink opening when the mounting plug is received within the mounting recess, whereby a user can open and close the lid by removing or inserting the drink plug from the drink opening while the tab closure remains mounted to the cap;

wherein the cap, cup mount, and tab closure all have a common thickness and are fabricated of a flexible, thin-walled plastic by a conventional thermoforming process.

46. A thermoformed disposable, recloseable lid for closing an open top of a cup terminating in an annular upper edge, the lid comprising:

a cup mount having an inner annular wall, an annular skirt spaced from the inner annular wall, and a top wall connecting the inner annular wall and annular skirt, with an annular channel for receiving an annular upper edge of a cup for mounting the lid to the cup defined by the inner annular wall, annular skirt, and top wall;

a cap comprising:

an upper surface located above the cup mount;

a peripheral wall extending upwardly from the cup mount to the upper surface to define a truncated-cone structure, at least a portion of which is above the cup mount; and a mounting recess formed in the upper surface and having a floor located below the upper surface and a peripheral wall connecting the floor to the upper surface, with the intersection of the peripheral wall and recess defining an opening to the recess in the upper surface;

a thin-walled hollow structure extending above the upper surface of the truncated cone structure and terminating in a top wall located above the upper surface and a drink opening located in the top wall; and a tab closure comprising a mounting plug and a drink plug connected by a strap, wherein:

the mounting plug has a bottom wall located below the strap and a peripheral wall extending upwardly from the bottom wall toward the strap, with at least a portion of the peripheral wall connected to the strap, with the bottom wall and peripheral wall defining a projection that is received within the mounting recess to mount the tab closure to the cap;

and the drink plug has a floor located below the strap and a peripheral wall extending upwardly from the bottom wall toward the strap, with at least a portion of the peripheral wall connected to the strap, with the floor and peripheral wall defining a projection that is received within the drink opening to close the drink opening;

wherein the strap is configured to permit the selective insertion and removal of the drink plug into the drink opening when the mounting plug is received within the mounting recess, whereby a user can open and close the lid by removing or inserting the drink plug from the drink opening while the tab closure remains mounted to the cap;

wherein the cup mount, cap, thin-walled hollow structure, and tab closure all have a common thickness and are fabricated of a flexible, thin-walled plastic by a conventional thermoforming process.

47. A thermoformed disposable, recloseable lid comprising:

a cup mount defining an annular channel for receiving an annular upper edge of a cup for mounting the lid to the cup;

a dome-shaped cap in the form of a truncated cone having an upper surface located above the cup mount and a peripheral wall connecting the upper surface with the cup mount, and sized to overlie and substantially cover the open top of the cup, with a mounting recess formed in the upper surface;

a thin-walled hollow structure at least partially encircling the upper surface and terminating in a top wall located above the upper surface, with a drink opening located in the top wall; and a tab closure comprising a mounting plug and a drink plug connected by a strap, wherein:

the mounting plug has a bottom wall located below the strap and a peripheral wall extending upwardly from the bottom wall toward the strap, with at least a portion of the peripheral wall connected to the strap, with the bottom wall and peripheral wall defining a projection that is received within the mounting recess to mount the tab closure to the cap;

and the drink plug has a floor located below the strap and a peripheral wall extending upwardly from the bottom wall toward the strap, with at least a portion of the peripheral wall connected to the strap, with the floor and peripheral wall defining a projection that is received within the drink opening to close the drink opening;

wherein the strap is configured to permit the selective insertion and removal of the drink plug into the drink opening when the mounting plug is received within the mounting recess, whereby a user can open and close the lid by removing or inserting the drink plug from the drink opening while the tab closure remains mounted to the cap;

wherein the cup mount, dome-shaped cap, thin-walled hollow structure, and tab closure all have a common thickness and are fabricated of a flexible, thin-walled plastic by a conventional thermoforming process.

* * * * *